US012557870B2

(12) United States Patent
Singh

(10) Patent No.: US 12,557,870 B2
(45) Date of Patent: Feb. 24, 2026

(54) KNITTED COMPONENT WITH ADJUSTABLE TENSIONING SYSTEM

(71) Applicant: NIKE, Inc., Beaverton, OR (US)

(72) Inventor: Gagandeep Singh, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/652,980

(22) Filed: Mar. 1, 2022

(65) Prior Publication Data

US 2022/0279898 A1 Sep. 8, 2022

Related U.S. Application Data

(60) Provisional application No. 63/157,385, filed on Mar. 5, 2021.

(51) Int. Cl.

| | |
|---|---|
| ***A43B 1/04*** | (2022.01) |
| ***A43B 23/02*** | (2006.01) |
| ***D04B 1/24*** | (2006.01) |

(52) U.S. Cl.

CPC ..... *A43B 1/04* (2013.01); *A43B 23/0245* (2013.01); *D04B 1/24* (2013.01)

(58) Field of Classification Search

None

See application file for complete search history.

(56) References Cited

U.S. PATENT DOCUMENTS 4,081,916 A * 4/1978 Salisbury ..... A43C 11/008 36/50.1
2008/0300683 A1 12/2008 Altman et al.
2012/0179252 A1 7/2012 Altman et al.
2012/0233882 A1 9/2012 Huffa et al.
2014/0196314 A1* 7/2014 Beye ..... B32B 3/08 428/166
2014/0237861 A1* 8/2014 Podhajny ..... D04B 15/56 66/170
2014/0338226 A1* 11/2014 Zavala ..... A43B 1/04 36/83
2015/0216253 A1 8/2015 Podhajny (Continued)

FOREIGN PATENT DOCUMENTS

CN 103517647 A 1/2014
CN 111970940 A 11/2020

(Continued)

OTHER PUBLICATIONS

Invitation to Pay Additional Fees received for International Patent Application No. PCT/US2022/018841, mailed on Jun. 3, 2022, 5 pages.

(Continued)

*Primary Examiner* — Megan E Lynch

(74) *Attorney, Agent, or Firm* — Shook, Hardy & Bacon, L.L.P.

(57) ABSTRACT

An article of footwear may include one or more of the following: a knitted component, the knitted component including a plurality of courses; and at least one inlaid strand, where the at least one inlaid strand is inlaid within at least one course of the plurality of courses, and where the at least one inlaid strand includes an exposed portion, the exposed portion at least partially extending through a throat area of the article of footwear when the article of footwear is in a wearable state.

9 Claims, 12 Drawing Sheets

(56) References Cited

U.S. PATENT DOCUMENTS

| | | | | |
|---|---|---|---|---|
| 2016/0058100 | A1* | 3/2016 | Dealey | A43B 23/042<br>12/142 G |
| 2016/0090670 | A1* | 3/2016 | Meir | D04B 1/123<br>66/190 |
| 2016/0206044 | A1* | 7/2016 | Dimoff | A43B 13/122 |
| 2017/0119083 | A1* | 5/2017 | Podhajny | D04B 1/123 |
| 2017/0202295 | A1* | 7/2017 | MacGilbert | A43B 1/04 |
| 2017/0202310 | A1* | 7/2017 | Spanks | A43B 5/06 |
| 2017/0280817 | A1* | 10/2017 | Hutchinson | A43B 3/0031 |
| 2018/0343966 | A1* | 12/2018 | Cook | A43B 7/141 |
| 2019/0307209 | A1* | 10/2019 | Houng | A43C 11/22 |
| 2019/0313741 | A1* | 10/2019 | Bell | A43B 23/0245 |
| 2019/0313742 | A1* | 10/2019 | Bell | A43C 1/04 |
| 2020/0046078 | A1 | 2/2020 | Durrell et al. | |
| 2021/0068502 | A1 | 3/2021 | Bell et al. | |
| 2023/0038383 | A1 | 2/2023 | Dua et al. | |

FOREIGN PATENT DOCUMENTS

| | | | |
|---|---|---|---|
| WO | 2015038448 | A2 | 3/2015 |
| WO | 2016123316 | A2 | 8/2016 |

OTHER PUBLICATIONS

International Search Report and Written Opinion received for PCT Patent Application No. PCT/US2022/018841, mailed on Aug. 8, 2022, 22 pages.

Office Action received for European Application No. 22713125.7, mailed on Jul. 24, 2024, 7 pages.

Office Action received for European Application No. 22713125.7, mailed on Dec. 2, 2024, 3 pages.

* cited by examiner

KNITTED COMPONENT WITH ADJUSTABLE TENSIONING SYSTEM

CROSS-REFERENCE TO RELATED APPLICATIONS

This application, entitled "Knitted Component with Adjustable Tensioning System," claims the benefit of priority of U.S. Prov. App. No. 63/157,385, entitled "Knitted Component with Adjustable Tensioning System" and filed Mar. 5, 2021. The entirety of the aforementioned application is incorporated by reference herein.

BACKGROUND

Conventional articles of footwear generally include two primary elements: an upper and a sole structure. The upper is generally secured to the sole structure and may form a void within the article of footwear for comfortably and securely receiving a foot. The sole structure is generally secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and may form a ground-engaging portion of the sole structure that is formed from a durable and wear-resistant material.

The upper of the article of footwear generally extends over the instep and toe areas of the foot, along the medial and lateral sides of the foot, and around the heel area of the foot and in some instances under the foot. Access to the void in the interior of the upper is generally provided by an ankle opening in and/or adjacent to a heel region of the footwear. A lacing system is often incorporated into the upper to adjust the fit of the upper, thereby facilitating entry and removal of the foot from the void within the upper. In addition, the upper may include a tongue that extends under the lacing system to enhance adjustability of the footwear, and the upper may incorporate other structures such as, for example, a heel counter to provide support and limit movement of the heel.

BRIEF DESCRIPTION OF THE DRAWINGS

Examples of aspects herein are described in detail below with reference to the attached figures, wherein.

DETAILED DESCRIPTION

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to identify different elements of methods employed, the terms should not be interpreted as implying any particular order among or between various steps herein disclosed unless and except when the order of individual steps is explicitly stated.

Certain aspects of the present disclosure relate to a knitted component configured for use in an article of footwear and/or other articles, such as articles of apparel. When referring to articles of footwear, the disclosure may describe basketball shoes, running shoes, biking shoes, cross-training shoes, football shoes, golf shoes, hiking shoes and boots, ski and snowboarding boots, soccer shoes, tennis shoes, and/or walking shoes, as well as footwear styles generally considered non-athletic, including but not limited to dress shoes, loafers, and sandals.

Figure 2:
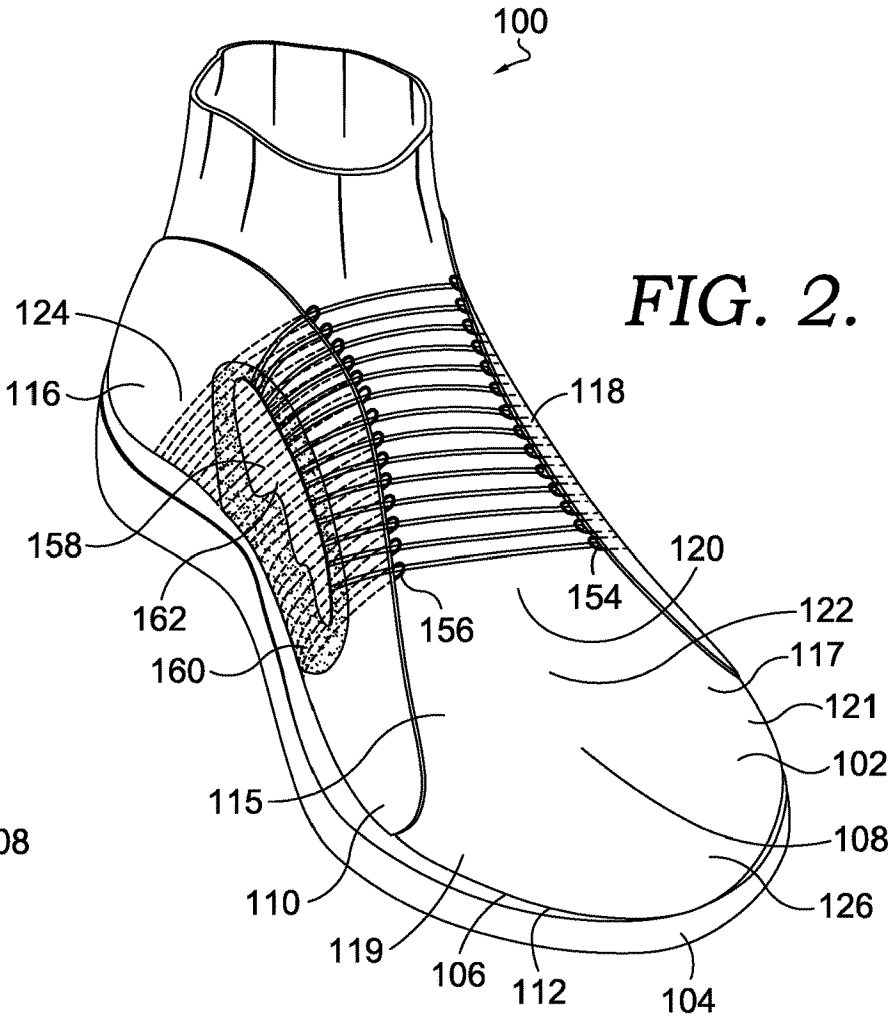
FIG. 2 is an illustration showing the article of footwear of FIG. 1 including a knitted component with an adjustable tensioning system in a taut configuration in accordance with certain aspects herein.
Figure 1:
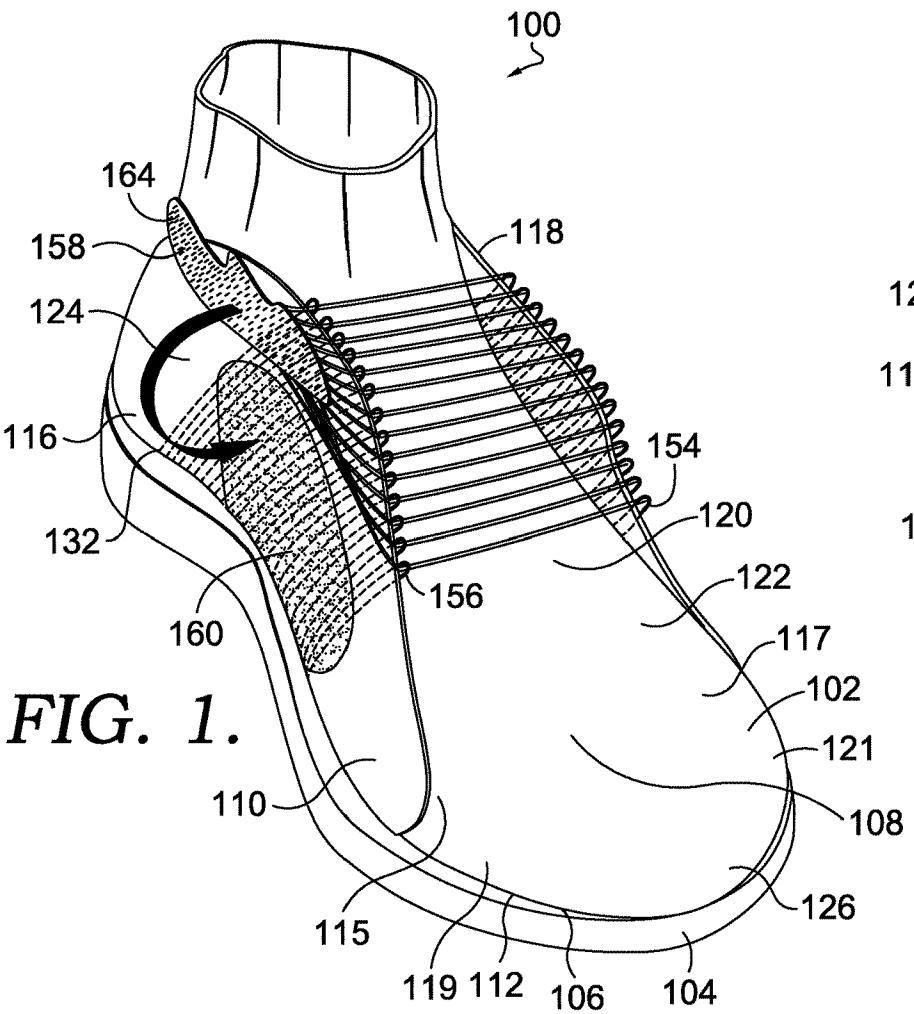
FIG. 1 is an illustration showing an article of footwear including a knitted component with an adjustable tensioning system in a slack configuration in accordance with certain aspects herein.

FIGS. 1 and 2 are illustrations showing an example of an article of footwear 100 having an adjustable tensioning system in a slack (or un-tensioned) configuration and in a taut (or tensioned) configuration, respectively. The article of footwear 100 may include a first knitted component 102 (or another suitable textile component) that at least partially forms an overfoot portion 108 that is secured to a sole structure 104. The area where the sole structure 104 joins the first knitted component 102 may be referred to as a biteline 106. The first knitted component 102 may be joined to the sole structure 104 in a fixed manner using any suitable technique, such as through the use of an adhesive, by sewing, etc. The sole structure 104 may define the bottom surface of a void for receiving and accommodating a user's foot, and the first knitted component 102 may define the sides of the void. In some embodiments, the first knitted component 102 may be configured to form a seamless bootie/sock or textile upper (e.g., unitary knit construction), which at least partially forms the overfoot portion 108 and an underfoot portion 112 extending underfoot.

The first knitted component 102 may include a medial side 115 and a lateral side 117 which at least partially forms the medial side 119 and the lateral side 121 of the article of footwear 100, respectively. A throat area 120 of the article of footwear 100 may be included between the medial side 119 and the lateral side 121, and the throat area 120 may be positioned to cover the top (dorsal) surface of the foot during typical use. A midfoot area 122 of the article of footwear 100 may be located between a heel area 124 and a toe area 126. The throat area 120 may be primarily located in the midfoot area 122. In some embodiments, an optional tongue may be disposed at least partially in the throat area 120.

Figure 3:
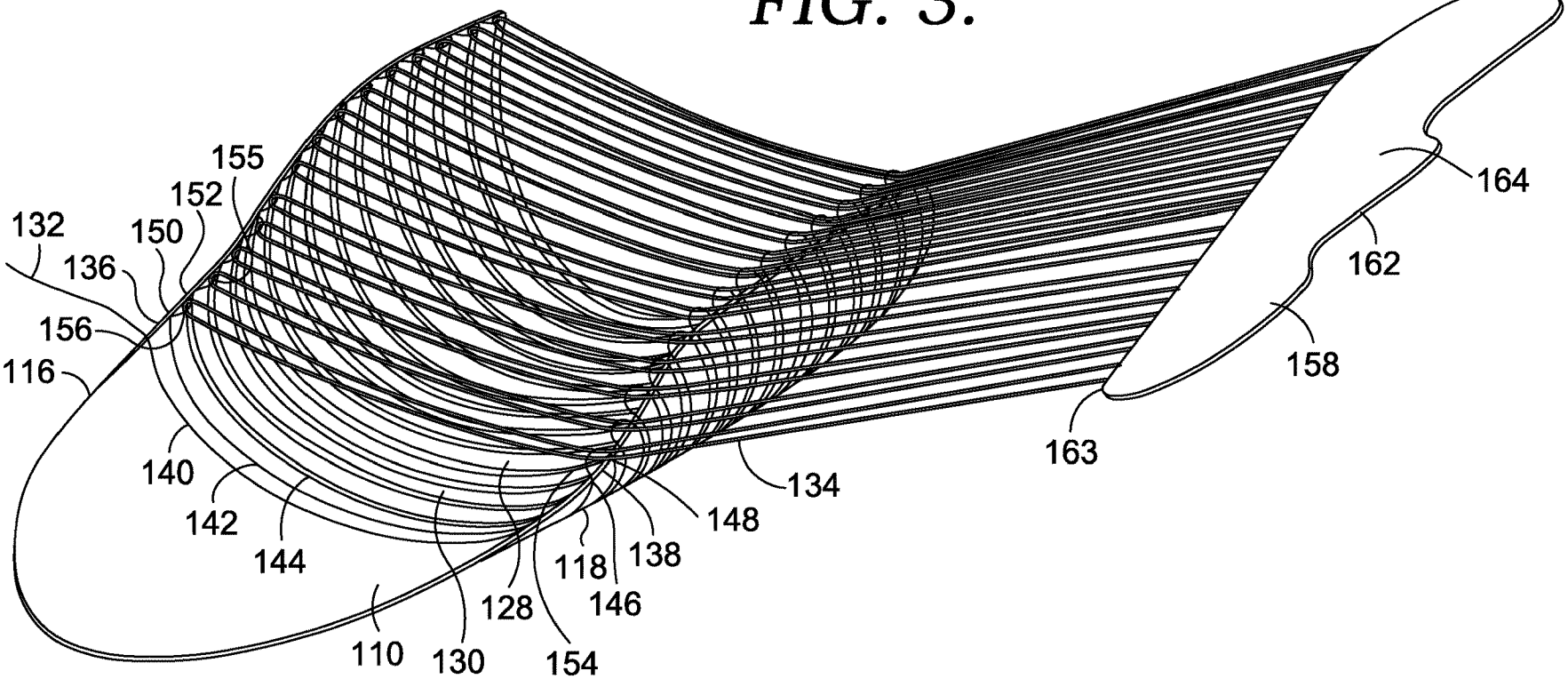
FIG. 3 is an illustration showing an embodiment of a knitted component including an adjustable tensioning system in accordance with certain aspects herein.
Figure 4:
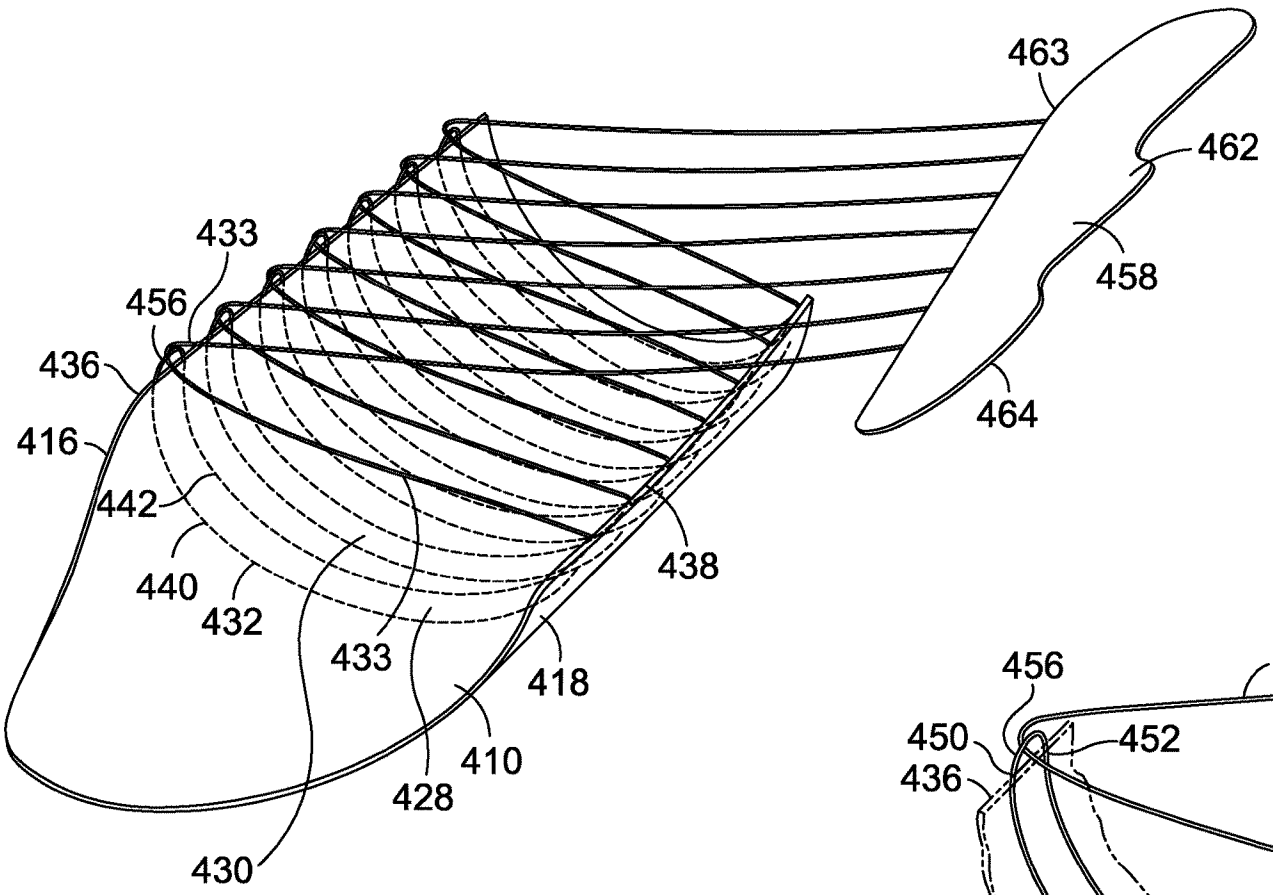
FIG. 4 is an illustration showing another embodiment of a knitted component including an adjustable tensioning system in accordance with certain aspects herein.

The article of footwear 100 may also include a second knitted component 110 that at least partially forms the underfoot portion 112, the heel area 124, the medial side 119, and/or the lateral side 121 of the article of footwear 100. FIGS. 3 and 4 show embodiments of the second knitted component 110 as it may appear after knitting and being manipulated into a wearable shape to form at least a portion of an article of footwear 100. The second knitted component 110 may include a medial side 116, a lateral side 118, and a middle portion 128 disposed between the medial side 116 and the lateral side 118. In some embodiments, as shown in FIGS. 3 and 4, when the second knitted component 110 is manipulated into the wearable shape, the medial and lateral sides 116 and 118 may be folded upwardly and inwardly such that a valley 130 is formed between the medial and lateral sides 116 and 118. While the second knitted component 110 as shown in FIGS. 3 and 4 has a relatively symmetrical configuration, in some embodiments, the second knitted component 110 may have a non-symmetrical configuration (e.g., one of the medial side 116 or the lateral side 118 has a greater length than the other).

In some embodiments, as shown in FIGS. 1 and 2, in forming the article of footwear 100, the second knitted component 110 may be wrapped around at least a portion of the first knitted component 102 such that the medial side 116 and lateral side 118 of the second knitted component 110 are disposed adjacent to and at least partially cover the medial side 115 and the lateral side 117 of the first knitted component 102, respectively. The second knitted component 110 may be wrapped around at least a portion of the first knitted component 102 such that each of the one or more pairs of corresponding exposed loops (e.g., 154 and 156, discussed below) respectively disposed on the medial and lateral sides 116 and 118 of the second knitted component 110 are aligned in registration with each other. At least a portion of the overfoot portion 108 and the throat area 120 of the first knitted component 102 are received within the valley 130 and disposed between the medial and lateral sides 116 and 118 of the second knitted component 110. The middle portion 128 of the second knitted component 110 at least partially forms the underfoot portion 112 of the article of footwear 100. The medial side 115 of the first knitted component 102 and the medial side 116 of the second knitted component 110 may collectively form the medial side 119 of the article of footwear 100. The lateral side 117 of the first knitted component 102 and the lateral side 118 of the second knitted component 110 may collectively form the lateral side 121 of the article of footwear 100.

Each of the first and second knitted components 102 and 110 may be formed primarily as an integral one-piece element during a knitting process, such as a weft knitting process (e.g., with a flat knitting machine or circular knitting machine), a warp knitting process, or any other suitable knitting process. That is, the knitting process on the knitting machine may substantially form the knit structure of each of the first and second knitted components 102 and 110 without the need for significant post-knitting processes or steps. Alternatively, each of the first and second knitted components 102 and 110 may be formed separately as distinct integral one-piece elements and then the respective elements attached (e.g., via sewing).

Forming the article of footwear 100 with knitted components may impart advantageous characteristics including, but not limited to, a particular degree of elasticity (as expressed in terms of Young's modulus, for example), breathability, bendability, strength, moisture absorption, weight, abrasion resistance, or a combination thereof. These characteristics may be accomplished by selecting a particular single-layer or multi-layer knit structure (e.g., a ribbed knit structure, a single jersey knit structure, or a double jersey knit structure), varying the size and tension of the knit structure, using one or more yarns formed of a particular material (e.g., a polyester material, a relatively inelastic material, or a relatively elastic material such as spandex), selecting yarns of a particular size (e.g., denier), or a combination thereof. The knitted components may also provide desirable aesthetic characteristics by incorporating yarns having different colors, textures or other visual properties arranged in a particular pattern. The yarns themselves and/or the knit structure formed by one or more of the yarns of the knitted components may be varied at different locations to provide different knit portions with different properties.

In some embodiments, as shown in FIGS. 3 and 4, the second knitted component 110 is formed from at least one yarn that is manipulated (e.g., with a knitting machine) to form a plurality of intermeshed loops that define a variety of courses and wales. At least one inlaid strand 132 may extend through at least one course of the plurality of courses and pass between the various loops within the second knitted component 110. Although the inlaid strand 132 generally extends along courses within the second knitted component 110, the inlaid strand 132 may also extend along wales within the second knitted component 110. Advantages of the inlaid strand 132 include providing support, stability, and structure. For example, the inlaid strand 132 assists with securing the second knitted component 110 around the foot, limits deformation in areas of the article of footwear 100 (e.g., imparts stretch-resistance), and operates in connection with a fastening system 134 (e.g., a strap) to enhance the fit of the article of footwear 100, as discussed in greater detail below.

In addition to yarn, the inlaid strand 132 may have the configuration of a filament (e.g., a monofilament), thread, rope, webbing, cable, or chain, for example. In comparison with the thickness of the yarn(s) forming the second knitted component 110, the thickness of the inlaid strand 132 may be greater. In some configurations, the inlaid strand 132 may have a significantly greater thickness than the yarn(s) of the second knitted component 110. Although the cross-sectional shape of the inlaid strand 132 may be round, triangular, square, rectangular, or elliptical, irregular shapes may also be utilized. Moreover, the materials forming the inlaid strand 132 may include any of the materials forming the yarn(s) within the second knitted component 110, such as cotton, elastane, polyester, rayon, wool, and/or nylon. The inlaid strand 132 may exhibit greater stretch-resistance than the second knitted component 110. As such, suitable materials for the inlaid strand 132 may include a variety of engineering filaments that are utilized for high tensile strength applications, including glass, aramids (e.g., para-aramid and meta-aramid), ultra-high-molecular-weight polyethylene, and/or liquid crystal polymer. As another example, a braided polyester thread may also be utilized as the inlaid strand 132.

In some embodiments, as shown in FIG. 3, the inlaid strand 132 may extend into the second knitted component 110 from a first edge 136 of the medial side 116 of the second knitted component 110 along a first course 140 toward a second edge 138 of the lateral side 118 of the second knitted component 110. That is, when incorporated into the article of footwear 100, the inlaid strand 132 extending through the second knitted component 110 may at least partially extend into the underfoot portion 112 of the article of footwear 100. In other embodiments, the inlaid strand 132 may extend into the second knitted component 110 from the second edge 138 of the lateral side 118 of the second knitted component 110 toward the first edge 136 of the medial side 116 of the second knitted component 110, and one of ordinary skill in the art will readily comprehend how the inlaid strand 132 may extend through the second knitted component 110, form the exposed loops (e.g., 154 and 156) (discussed below), and interact with fastening systems (e.g., 134) to form an adjustable tensioning system in these embodiments.

In some embodiments, as shown in FIG. 3, the inlaid strand 132 may exit the second edge 138 at a first location 146 and then re-enter the second knitted component 110 at a second location 148, such that a first exposed loop 154 may be formed by the inlaid strand 132 on the second edge 138 between the first and second locations 146 and 148. The first and second locations 146 and 148 may be varied, as desired and/or needed, such that the size of the first exposed loop 154 may be varied. Then, the inlaid strand 132 may extend along a second course 142 toward the medial side 116, exit the first edge 136 at a third location 150, re-enter the second knitted component 110 at a fourth location 152, and then extend along a third course 144 toward the lateral side 118, such that a second exposed loop 156 may be formed by the inlaid strand 132 on the first edge 136 between the third and fourth locations 150 and 152. The third and fourth locations 150 and 152 may be varied, as desired and/or needed, such that the size of the second exposed loop 156 may be varied.

In some embodiments, as shown in FIG. 3, the inlaid strand 132 may pass back and forth through the second knitted component 110. That is, the inlaid strand 132 may repeatedly exit the second knitted component 110 at the first and second edges 136 and 138 and then re-enter the second knitted component 110 at other locations of the first and second edges 136 and 138, respectively, such that a plurality of exposed loops may be formed along the first edge 136 of the medial side 116 and the second edge 138 of the lateral side 118, respectively. When the second knitted component 110 is in a wearable shape (e.g., as shown in FIG. 3), each of the exposed loops (e.g., the second exposed loop 156) disposed on the first edge 136 of the medial side 116 may correspond to and be aligned in registration with an exposed loop (e.g., the first exposed loop 154) disposed on the second edge 138 of the lateral side 118. When the second knitted component 110 is incorporated into the article of footwear 100, as shown in FIGS. 1 and 2, the exposed loops (e.g., the second exposed loop 156) disposed on the first edge 136 of the medial side 116 may be disposed on a medial side of the throat area 120, and the exposed loops (e.g., the first exposed loop 154) disposed on the second edge 138 of the lateral side 118 may be disposed on a lateral side of the throat area 120.

The exposed loops (e.g., first and second exposed loops 154 and 156) may be configured to engage a fastening system 134. The fastening system 134 may be a shoelace, a cable system, a strap, strands, or any other suitable component that has an elongated configuration that may extend through the exposed loops. The fastening system 134 may include, for example, any of the configurations and/or materials of the inlaid strand 132 (discussed above). The fastening system 134 may extend through and at least partially around an exposed loop disposed on one of the first edge 136 or the second edge 138 of the second knitted component 110 (e.g., be interlooped with the exposed loop), extend over the valley 130 between the medial and lateral sides 116 and 118 (and thus at least partially over the throat area 120 when incorporated into the article of footwear 100), and at least partially extend through another exposed loop disposed on the other one of the first edge 136 or the second edge 138 (which may correspond to and align in registration with the exposed loop that is interlooped with the fastening system 134). In this arrangement, when the second knitted component 110 is incorporated into the article of footwear 100 and the fastening system 134 is tensioned, the exposed loops engaged with the fastening system 134 and the corresponding inlaid strand 132 are pulled into tension to enhance the fit of the article of footwear 100 around a wearer's foot. In this embodiment, the inlaid strand 132 together with the fastening system 134 collectively form an adjustable tensioning system, as discussed in greater detail below.

In some embodiments, as shown in FIG. 3, the fastening system 134 may extend through and at least partially around the second exposed loop 156 (e.g., be interlooped with the second exposed loop 156), extend over the valley 130 between the medial and lateral sides 116 and 118 (and thus at least partially over the throat area 120 when incorporated into the article of footwear 100), at least partially extend through the first exposed loop 154, and be fixed to a strap fastener 158 using any suitable technique, such as through the use of an adhesive, by sewing, etc. In other embodiments, the fastening system 134 may extend through and at least partially around the first exposed loop 154 (e.g., interlooped with the first exposed loop 154), extend over the valley 130 (and thus at least partially over the throat area 120 when incorporated into the article of footwear 100), at least partially extend through the second exposed loop 156, and be fixed to a strap fastener 158 (e.g., as shown in FIGS. 1 and 2). As shown in FIG. 3, a plurality of fastening systems 134 may be included to engage the exposed loops, with each fastening system 134 engaging a pair of corresponding exposed loops disposed on the first and second edges 136 and 138 respectively. In other embodiments, each fastening system 134 may engage any two of the exposed loops that are respectively disposed on the first and second edges 136 and 138 (e.g., the fastening system 134 may engage the first exposed loop 154 on the second edge 138 and a third exposed loop 155 on the first edge 136).

Referring to FIGS. 1-3, in some embodiments, the strap fastener 158 may include a first surface 162 and an opposite second surface 164, and the fastening system 134 (e.g., in the embodiment shown in FIG. 3) may be fixed to the strap fastener 158 at an edge 163 disposed between the first surface 162 and the opposite second surface 164. In some embodiments, as shown in FIGS. 1 and 2, the medial side 116 and/or the lateral side 118 of the second knitted component 110 may include a surface fastener 160. The surface fastener 160 and the second surface 164 of the strap fastener 158 are configured such that the second surface 164 of the strap fastener 158 can be releasably secured to the surface fastener 160.

In some embodiments, as shown in FIGS. 1 and 2, the second surface 164 of the strap fastener 158 may have any desired shape with a dimension that is smaller than the dimension of the surface fastener 160. By pressing together the second surface 164 of the strap fastener 158 and the surface fastener 160, the second surface 164 of the strap fastener 158 and the surface fastener 160 are at least partially overlapped, such that they are secured together. By varying the sizes of the second surface 164 of the strap fastener 158 and the surface fastener 160, the size of the overlapping area may be varied as desired and/or needed. By varying the position of the second surface 164 of the strap fastener 158 with respect to the surface fastener 160, and by pressing together the second surface 164 of the strap fastener 158 and the surface fastener 160, the fastening system 134 (e.g., in the embodiment as shown in FIG. 3) may be tensioned, loosened, or otherwise adjusted, as desired and/or needed, such that the tension and shape of the second knitted component 110 may be adjusted and a desired fit of the article of footwear 100 over the wearer's foot may be obtained. This is advantageous for allowing the article of footwear 100 to be worn by different wearers and/or by the same wearer while his/her foot grows.

The length of the fastening system 134 may be varied, as desired and/or needed, without departing from the scope of the present invention. In some embodiments, as shown in FIGS. 1 and 2, the length of the fastening system 134 is relatively small, such that the strap fastener 158 may be attached to the fastening systems 134 extending through the exposed loops disposed on the first edge 136 of the medial side 116 and also may be directly secured to the surface fastener 160 disposed on the medial side 116 of the second knitted component 110 (forming an exterior surface of the article of footwear 100).

In some embodiments, as shown in FIG. 3, the fastening system 134 is relatively long, such that the exposed loops from which the portions of the fastening system 134 last extends and the surface fastener 160 may be on an opposite sides of the article of footwear 100. For example, portions of the fastening system 134 that are fixed to the strap fastener 158 may extend through exposed loops disposed on the second edge 138 of the lateral side 118 and may be wrapped upwardly over the valley 130 (and thus at least partially over the throat area 120 when incorporated into the article of footwear 100) and at least partially over the medial side 116, such that the strap fastener 158 may be secured to the surface fastener 160 disposed on the medial side 116 of the second knitted component 110 (forming an exterior surface of the article of footwear 100). As the fastening system 134 may exhibit greater stretch-resistance than the first and second knitted components 102 and 110, wrapping the fastening system 134 over the throat area 120 may impart additional stretch resistance to at least part of the overfoot portion 108 of the article of footwear 100 (e.g., including at least part of the throat area 120).

In some embodiments, the medial and lateral sides 116 and 118 of the second knitted component 110 may each include a surface fastener 160 disposed thereon at a desired location, and the length of the fastening system 134 may be selected such that by adjusting tension placed on the fastening system 134, the strap fastener 158 may be selectively secured to either one of the surface fasteners 160 disposed on the medial and lateral sides 116 and 118 of the second knitted component 110 (forming an exterior surface of the article of footwear 100).

In comparison with the first and second knitted components 102 and 110, the inlaid strand 132 may exhibit greater stretch resistance. That is, the inlaid strand 132 may stretch less than the first and second knitted components 102 and 110. In some embodiments as shown in FIGS. 1 and 2, given that numerous sections of the inlaid strand 132 may extend from the throat area 120 to the biteline 106 in both of the medial and lateral sides 116 and 118 of the second knitted component 110, the inlaid strand 132 may impart stretch resistance to the portion of the article of footwear 100 between the throat area 120 and the biteline 106 in both of the medial and lateral sides 119 and 121 of the article of footwear 100. Placing tension upon the fastening system 134 fixed to the strap fastener 158 may impart tension to the inlaid strand 132 extending between the throat area 120 and the biteline 106, thereby inducing the portion of the article of footwear 100 between the throat area 120 and the biteline 106 on both of the medial and lateral sides 119 and 121 of the article of footwear 100 to lie against the foot (e.g., inducing the medial side 116 of the second knitted component 110 to lie against the medial side 115 of the first knitted component 102 and/or inducing the lateral side 118 of the second knitted component 110 to lie against the lateral side 117 of the first knitted component 102).

In some embodiments, as shown in FIGS. 1 and 2, numerous sections of the inlaid strand 132 may extend into the heel area 124 and may impart stretch resistance to portions of the article of footwear 100 in the heel area 124. An advantage of this configuration is that the portions of the inlaid strand 132 extending into the heel area 124 at least partially wrap around the heel of the wearer and assist with securing the position of the heel within the article of footwear 100. Placing tension upon the fastening system 134 fixed to the strap fastener 158 may impart tension to the inlaid strand 132 extending in the heel area 124, thereby inducing the portions of the article of footwear 100 in the heel area 124 to lie against the foot. As such, the inlaid strand 132 operates (e.g., in connection with the fastening system 134) as an adjustable fastening system to enhance the fit of the article of footwear 100.

In use, referring to FIGS. 1 and 2, the second knitted component 110 included in the article of footwear 100 may have a slack configuration (e.g., as shown in FIG. 1) and a taut configuration (e.g., as shown in FIG. 2). When the article of footwear 100 is in the neutral position (e.g., as shown in FIG. 1, when a wearer can put his/her foot into the void), the inlaid strand 132 and the fastening system 134 may be relatively slack and have relatively low tension. After the wearer has put his/her foot into the void, the wearer may then place tension on the fastening system 134 (which thus pulls on the inlaid strand 132 through the exposed loops, such as exposed loops 156 and 154) by pulling the strap fastener 158 fixed to the fastening system 134 toward the medial side of the throat area 120 (e.g., as shown in FIG. 1), which causes the medial side 116 of the second knitted component 110 to lie against the medial side 115 of the first knitted component 102 and the lateral side 118 of the second knitted component 110 to lie against the lateral side 117 of the first knitted component 102 such that the shape of the article of footwear 100 can be adjusted to conform to the wearer's foot. After the article of footwear 100 is adjusted to a desired fit, the wearer may then secure the strap fastener 158 to the surface fastener 160 at a desired location by pressing the strap fastener 158 and the surface fastener 160 together. The fit of the article of footwear 100 may be easily adjusted by adjusting the tension on the fastening system 134 and securing the strap fastener 158 to the surface fastener 160 at other desired locations.

When the strap fastener 158 is secured to the surface fastener 160 (e.g., when the second knitted component 110 is in the taut configuration, as shown in FIG. 2), the fastening system 134 and the inlaid strand 132 may prevent the first knitted component 102 from continuing to stretch beyond a predetermined position associated with the stretched position (after the wearer's foot is placed in the void) shown in FIG. 2. The fastening system 134 and the inlaid strand 132 may provide support to the first and second knitted components 102 and 110 and allow the first and second knitted components 102 and 110 to resist deformation or stretching or otherwise provide support for the wearer's foot during running, jumping, or other movements of the wearer's foot.

Figure 4A:
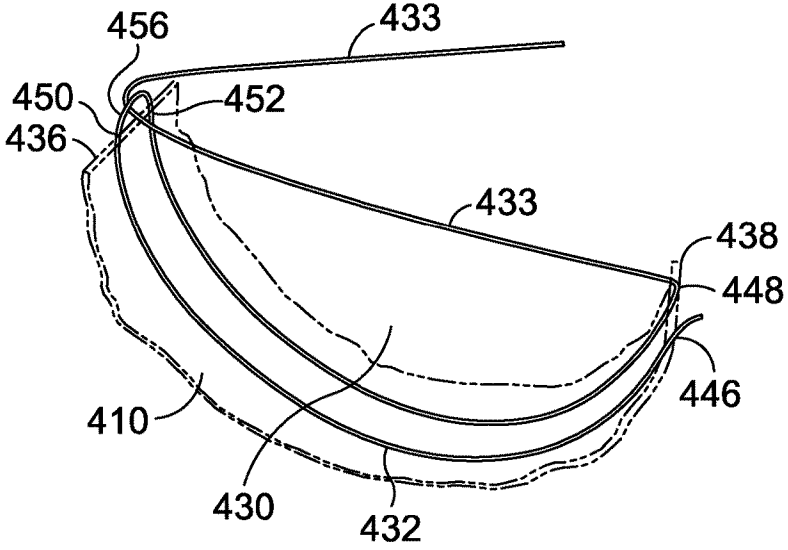
FIG. 4A is an illustration showing a portion of the knitted component including an adjustable tensioning system of FIG. 4 in accordance with certain aspects herein.

FIG. 4 depicts another embodiment of a knitted component including 410 an adjustable tensioning system, and FIG. 4A depicts a close-up view of a portion of the knitted component of FIG. 4. The knitted component 410 of FIGS. 4 and 4A may be used in a similar manner as the second knitted component 110 of FIG. 3 and may be similarly incorporate the article of footwear 100 of FIGS. 1 and 2 except that the strap fastener is attached to inlaid strands forming the exposed loops, instead of a separate fastening system. As such, the knitted component 410 may have similar features and properties as the second knitted component 410 except where otherwise specified. For example, the knitted component 410 may include a first edge 436 on a medial side 416 and a second edge 438 on a lateral side 418.

As shown in FIGS. 4 and 4A, an inlaid strand 432, which may be made of any of the materials and have any of the properties described for the inlaid strand 132, may extend into the knitted component 410 from the second edge 438 of the lateral side 418 at a first location 446, along a first course 440 toward the first edge 436 of the medial side 416. That is, when incorporated into an article of footwear, such as the article of footwear 100, the inlaid strand 432 extending through the knitted component 410 may at least partially extend into an underfoot portion of the article of footwear 100 (such as underfoot portion 112). In other embodiments, the inlaid strand 432 may extend into the knitted component 410 from the first edge 436 of the medial side 416 toward the second edge 438 of the lateral side 418, and one of ordinary skill in the art will readily comprehend how the inlaid strand 432 may extend through the knitted component 410 and interact with the formed exposed loops to form an adjustable tensioning system in these embodiments.

As shown in FIGS. 4 and 4A, the inlaid strand 432 may exit the first edge 436 at a second location 450 and then re-enter the knitted component 410 at a third location 452 on the first edge 436, such that an exposed loop 456 is formed by the inlaid strand 432 between the second and third locations 450 and 452. The second and third locations 450 and 452 may be varied, as desired and/or needed, such that the size of the exposed loop 456 may be varied. Then, the inlaid strand 432 may extend along a second course 442 toward the lateral side 418 and exit the second edge 438 at a fourth location 448.

After exiting at the fourth location 448, the inlaid strand 432 may extend back toward the first edge 436 of the medial side 416, over the valley 430 between the medial and lateral sides 416 and 418 (and thus at least partially over the throat area when incorporated into an article of footwear, such as the throat area 120 of the article of footwear 100), and then extend through the exposed loop 456. The portion of the inlaid strand 432 that extends over the valley 430 and through the exposed loop 456 is an exposed portion 433 that is not inlaid within the knitted component 410. That is, the inlaid strand 432 may include an exposed loop on a first side of the knitted component 410 (e.g., the medial side 416 or the lateral side 418), and the exposed portion 433 of the inlaid strand 432 may extend from a second side of the knitted component 410 (e.g., the lateral side 418 or the medial side 416), over the valley 430 (and thus at least partially over the throat area when incorporated into an article of footwear, such as the throat area 120 of the article of footwear 100), and through the exposed loop on the first side of the knitted component 410.

After the extending through the exposed loop 456, the inlaid strand 432 may extend back toward the lateral side 418 such that at least a portion of the inlaid strand 432 (e.g., the exposed portion 433) extending through the exposed loop 456 becomes interlooped with the exposed loop 456 on the medial side 416. The inlaid strand 432 (e.g., the exposed portion 433) may then extend over the valley 430 between the medial and lateral sides 416 and 418 and be fixed to a strap fastener 458 (which may have similar features and properties as the strap fastener 158) using any suitable technique, such as through the use of an adhesive, by sewing, etc. In this arrangement, when the knitted component 410 is incorporated into an article of footwear, such as the article of footwear 100, and a portion of the inlaid strand 432 that is fixed to the strap fastener 458 is tensioned (e.g., by pulling on the strap fastener 458), the exposed loop 456 engaged with the portion of the inlaid strand 432 that is fixed to the strap fastener 458 is pulled into tension, and thus the remaining portions of the inlaid strand 432 are also pulled into tension to enhance the fit of the article of footwear around a wearer's foot. In this embodiment, the inlaid strand 432 by itself forms an adjustable tensioning system, as discussed in greater detail below.

As shown in FIG. 4, a plurality of inlaid strands 432 may be included in the knitted component 410 with each inlaid strand 432 extending between the medial and lateral sides 416 and 418 in the same manner as discussed above while along courses other than the first and second courses 440 and 442. As shown in FIG. 4, the plurality of inlaid strands 432 may be spaced apart, with each inlaid strand 432 extending along its respective course at a desired location, such that a plurality of spaced-apart exposed loops may be formed along the first edge 436 of the medial side 416. Each inlaid strand 432 is fixed to the strap fastener 458 such that the tension on each inlaid strand 432 can be adjusted simultaneously by pulling on the strap fastener 458. The number of inlaid strands 432 included in the knitted component 410 and the spacing therebetween may be varied, as desired and/or needed, without departing from the scope of the present disclosure.

As similarly discussed with respect to the embodiment shown in FIG. 3, when the knitted component 410 is in the wearable shape (e.g., as shown in FIG. 4) and is incorporated into an article of footwear, such as the article of footwear 100, the exposed loops (e.g., the exposed loop 456) disposed on the first edge 436 of the medial side 416 may be disposed on a medial side of the throat area (such as the throat area 120 of the article of footwear 100), and the strap fastener 458 fixed to the inlaid strand 432 may be configured to selectively secure to a surface fastener, similar to the surface fastener 160 of FIGS. 1 and 2, disposed on the medial side 416 of the second knitted component 410 (forming an exterior surface of the article of footwear) at a desired location, as discussed in greater detail below.

The strap fastener 458 in FIG. 4 may releasably mate with a surface fastener in the same manner described for strap fastener 158 except where otherwise indicated and, as such, not all details are replicated here. For example, the inlaid strands 432 may be fixed to the strap fastener 458 at an edge 463 disposed between a first surface 462 and the opposite second surface 464 of the strap fastener 468. The second surface 464 of the strap fastener 458 may be configured to be releasably secured to a surface fastener on a medial or lateral aide of an article of footwear, similar to the surface fastener 160. Varying the position of the second surface 464 of the strap fastener 458 with respect to the surface fastener and pressing together the second surface 464 of the strap fastener 458 and the surface fastener may result in the inlaid strands 432 being tensioned, loosened, or otherwise adjusted, as desired and/or needed, such that the tension and shape of the second knitted component 410 may be adjusted and a desired fit of the article of footwear may be obtained.

Similar to the fastening system 134, the length of the inlaid strands 432 may be varied, as desired and/or needed, without departing from the scope of the present invention. For example, in some embodiments, as shown in FIG. 4, the inlaid strands 432 are relatively long, such that the portions of the inlaid strands 432 that extend through the exposed loops disposed on the first edge 436 of the medial side 416 and fixed to the strap fastener 458 may be wrapped upwardly over the valley 430 (and thus at least partially over a throat area when incorporated into the article of footwear, such as throat area 120) and at least partially over the lateral side 418, such that the strap fastener 458 may be secured to a surface fastener disposed on the lateral side 418 of the second knitted component 410 (forming an exterior surface of the article of footwear). As the inlaid strands 432 may exhibit greater stretch resistance than the first knitted component (such as the first knitted component 102) and the second knitted component 410, wrapping the inlaid strands 432 over the throat area (e.g., throat area 120) may impart additional stretch resistance to at least part of an overfoot portion, such as the overfoot portion 108 of the article of footwear 100 (e.g., including at least part of the throat area 120).

In some embodiments, the medial and lateral sides 416 and 418 of the second knitted component 410 may each include a surface fastener disposed thereon at a desired location, and the length of the inlaid strands 432 may be selected such that by adjusting tension placed on the inlaid strands 432, the strap fastener 458 may be selectively secured to either one of the surface fasteners disposed on the medial and lateral sides 416 and 418.

Further, because the inlaid strands 432 may stretch less than a first knitted component, such as the first knitted component 102, and the second knitted component 410, and because sections of the inlaid strands 432 may extend from a throat area (e.g., the throat area 120) to a biteline (e.g., the biteline 106) in both of the medial and lateral sides 416 and 418, the inlaid strands 432 may impart stretch resistance to the portion of the article of footwear (e.g., the article of footwear 100) between the throat area and the biteline in both of the medial and lateral sides of the article of footwear 100 as previously described with respect to FIGS. 1-3 except that tension is placed upon the inlaid strands 432 instead of the fastening system 134. Similarly, numerous sections of the inlaid strands 432 may extend into a heel area of an article of footwear (such as the heel area 124) and may impart stretch resistance to portions of the article of footwear in the heel area and tension may be applied to the inlaid strands 432 in the heel area in a similar manner as described with respect to FIGS. 1-3 except that tension is adjusted through the inlaid strands 432, not the fastening system 134.

As can be appreciated by one having ordinary skill in the art, the second knitted component 410 may have a slack (or neutral) configuration similar to the configuration shown in FIG. 1 and a taut configuration similar to the configuration shown in FIG. 2. One of ordinary skill in the art will readily comprehend how the second knitted component 410 shown in FIG. 4 may be adjusted between a slack configuration and a taut configuration (e.g., when incorporated into an article of footwear 100) in a similar manner described for the second knitted component 110 of FIGS. 1-3.

Figure 5:
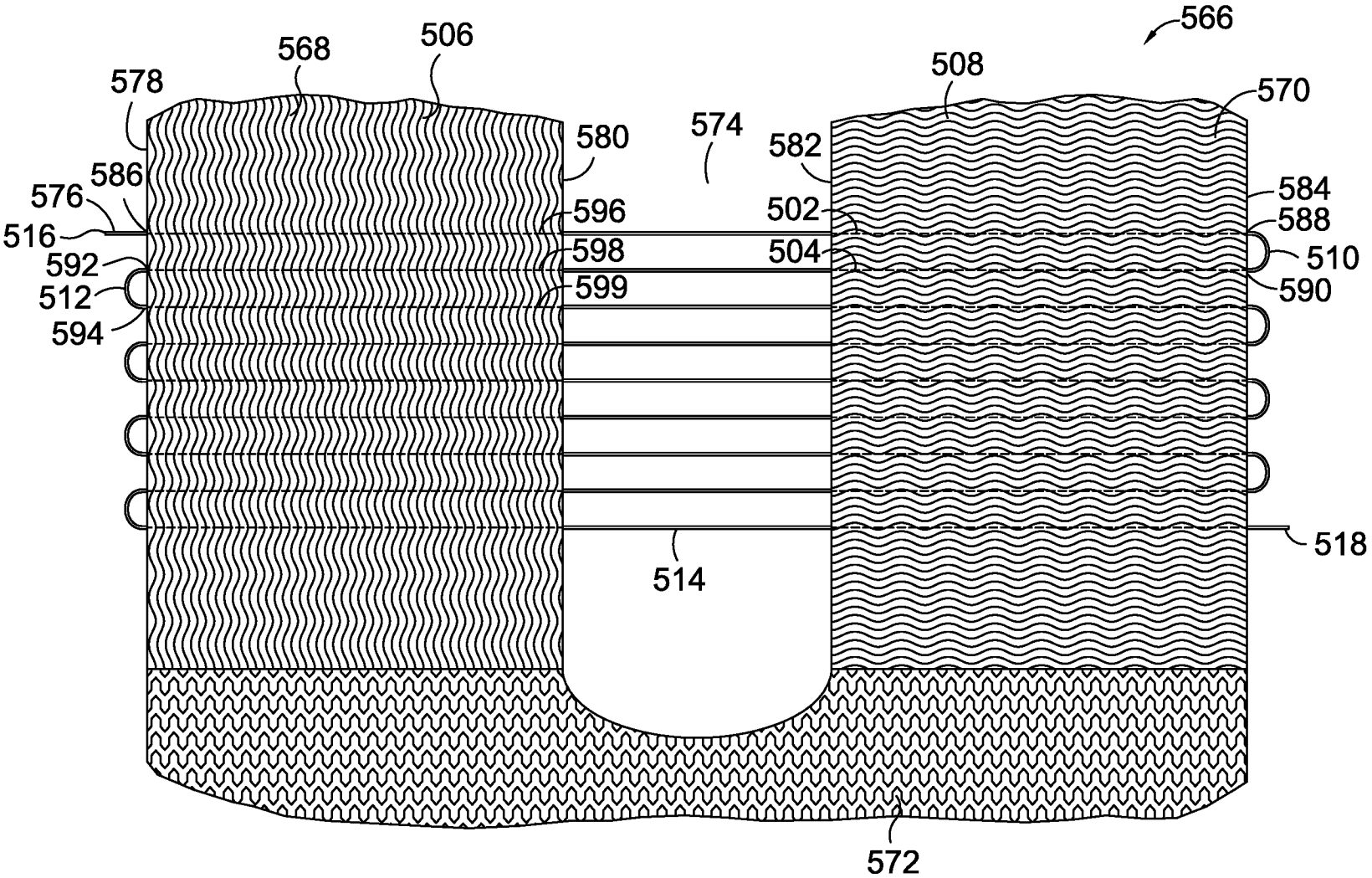
FIG. 5 is an illustration showing an embodiment of a textile component in accordance with certain aspects herein.

FIG. 5 depicts a textile component 566 may include a first textile portion 568, a second textile portion 570, and a third textile portion 572. A gap 574 may be disposed between the first and second textile portions 568 and 570. The third textile portion 572 is optional. That is, in some embodiments, the textile component 566 may include a first textile portion 568 and a second textile portion 570 that are completely separate with a gap 574 disposed between and along the entire lengths of the first and second textile portions 568 and 570. In some embodiments, the first textile portion 568 is a knitted portion including a first plurality of knit courses 506, and the second textile portion 570 is also a knitted portion including a second plurality of knit courses 508. In some embodiments, only one of the first and second textile portions 568 and 570 is a knitted portion. The gap 574 does not have knit courses.

In some embodiments, as shown in FIG. 5, the textile component 566 may include at least one strand 576 extending from the first textile portion 568 to the second textile portion 570. In some embodiments, where the first textile portion 568 is a knitted portion, the at least one strand 576 may be inlaid within at least one course of the first plurality of knit courses 506, extend through the gap 574 between the first and second textile portions 568 and 570, and extend at least partially into the second textile portion 570 or otherwise be secured to the second textile portion 570.

In some embodiments, where the first and second textile portions 568 and 570 are both knitted portions, the strand 576 may be inlaid in both of the first and second textile portions 568 and 570. As shown in FIG. 5, for example, the inlaid strand 576 may extend into the first textile portion 568 from a first side 578 of the first textile portion 568 at a first location 586, along a first course 596 of the first plurality of knit courses 506, toward a second side 580 of the first textile portion 568. The inlaid strand 576 may then exit the first textile portion 568, extend through the gap 574, extend into the second textile portion 570 from a first side 582 of the second textile portion 570, along a first course 502 of the second plurality of knit courses 508 toward the second side 584 of the second textile portion 570. The inlaid strand 576 may exit the second side 584 of the second textile portion 570 at a second location 588 and re-enter the second side 584 at a third location 590, such that an exposed loop 510 may be formed on the second side 584 between the second and third locations 588 and 590.

The inlaid strand 576 may then extend along a second course 504 of the second plurality of knit courses 508 toward the first side 582 of the second textile portion 570, exit the first side 582, extend through the gap 574, and enter the second side 580 of the first textile portion 568. Then the inlaid strand 576 may extend along a second course 598 of the first plurality of knit courses 506 toward the first side 578 of the first textile portion 568. Then the inlaid strand 576 may exit the first side 578 at a fourth location 592, re-enter the first side 578 at a fifth location 594, and extend along a third course 599 of the first plurality of knit courses 506 toward the second side 580 of the first textile portion 568. Another exposed loop 512 may be formed on the first side 578 between the fourth and fifth locations 592 and 594.

As shown in FIG. 5, the inlaid strand 576 may pass back and forth through the first textile portion 568, the gap 574, and the second textile portion 570. That is, the inlaid strand 576 may repeatedly exit the second side 584 of the second textile portion 570 and re-enter the second side 584 at another location such that a plurality of exposed loops (e.g., exposed loop 510) may be formed on the second side 584 of the second textile portion 570. The inlaid strand 576 may also repeatedly exit the first side 578 of the first textile portion 568 and re-enter the first side 578 at another location such that a plurality of exposed loops may be formed on the first side 578 of the first textile portion 568. As the inlaid strand 576 repeatedly passes back and forth through the gap 574 from the first textile portion 568 to the second textile portion 570 or from the second textile portion 570 to the first textile portion 568, a plurality of exposed portions 514 of the inlaid strand 576 are disposed within the gap 574.

The inlaid strand 576 may provide stretch resistance to the first and second textile portions 568 and 570. The distance between the fourth and fifth locations 592 and 594 may be varied such that the shape and size of the exposed loop 512 may be varied, and the distance between the second and third locations 588 and 590 may be varied such that the shape and size of the exposed loop 510 may be varied. The spacing between the first, second, and third courses 596, 598, and 599 of the first plurality of knit courses 506 and/or the spacing between the first and second courses 502 and 504 of the second plurality of knit courses 508 may be varied to achieve a desired density of the inlaid strand 576 in the textile component 566 and thus to achieve desired stretch-resistance in desired locations.

The stretch resistance of the textile component 566 may be adjusted by manipulating a first end 516 and/or a second end 518 of the inlaid strand 576 (e.g., by pulling the first end 516 and the second end 518 outwardly from the respective first and second sides 578 and 584) until desired tension is placed upon the inlaid strand 576 (and thus upon the textile component 566). Then, the portions of the inlaid strand 576 extending outwardly from the first side 578 of the first textile portion 568 and the second side 584 of the second textile portion 570 may be respectively joined to the textile component 566 in a fixed manner using any suitable technique, such as through the use of an adhesive, by sewing, etc.

In this manner, the textile component 566 forms an independent component with a desired stretch resistance that may be incorporated into a variety of products for both personal and industrial purposes. For example, the textile component 566 may be utilized in an article of footwear (similar to the article of footwear 100 of FIGS. 1 and 2), with the first textile portion 568 secured to a first side (e.g., the medial or lateral side) of the article of footwear, the second textile portion 570 secured to a second side (e.g., the lateral or medial side) of the article of footwear, and the exposed portions 514 extending over the throat area of the article of footwear, thereby providing support, stability, and structure to the article of footwear at desired locations. As another example, the textile component 566 may be utilized in other types of apparel (e.g., shirts, pants, socks, jackets, and undergarments), athletic equipment (e.g., golf bags, baseball and football gloves, and soccer ball restriction structures), containers (e.g., backpacks and bags), and upholstery for furniture (e.g., chairs, couches, and car seats). As another example, the textile component 566 may be utilized in bed coverings (e.g., sheets and blankets), table coverings, towels, flags, tents, sails, and parachutes. As another example, the textile component 566 may be utilized as a technical textile for industrial purposes, including structures for automotive and aerospace applications, filter materials, medical textiles (e.g., bandages), geotextiles for reinforcing embankments, agrotextiles for crop protection, and industrial apparel that protects or insulates against heat and/or radiation.

Figure 6A:
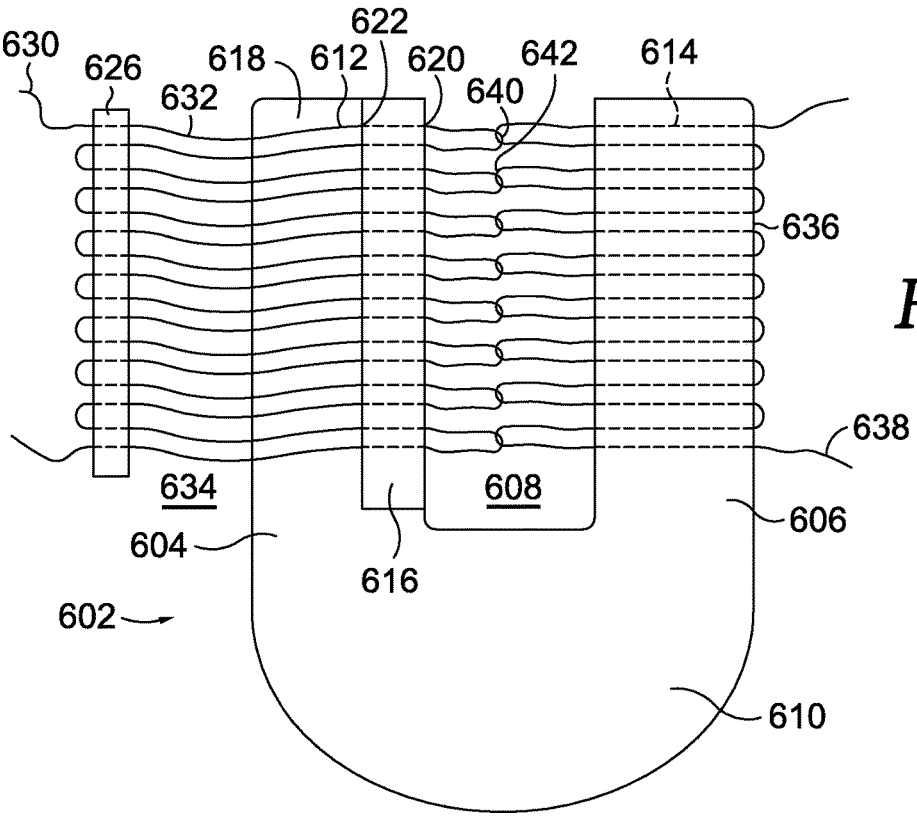
FIG. 6A is an illustration showing a textile component for use in an upper, where the textile component includes two separate inlaid strands that interloop in a gap between knitted portions in accordance with certain aspects herein.
Figure 6B:
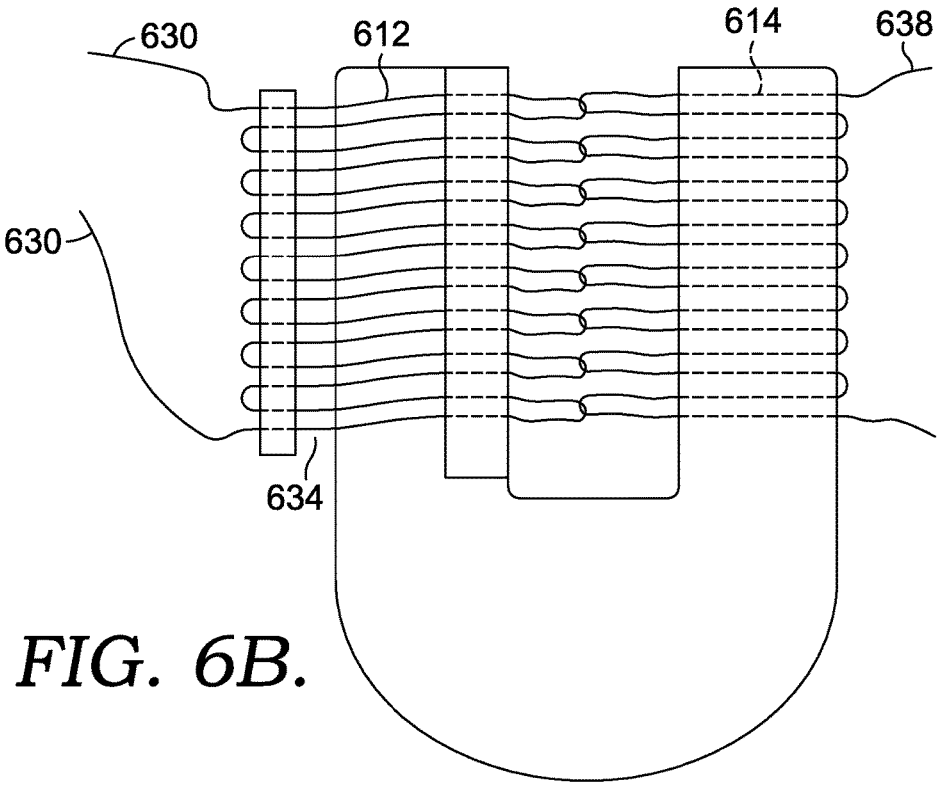
FIG. 6B is an illustration showing the textile component of FIG. 6A, where slack of an inlaid strand between two separate knitted portions has been adjusted relative to the configuration depicted in FIG. 6A in accordance with certain aspects herein.

FIGS. 6A and 6B show another embodiment of a textile component 602, which may be a knitted component (e.g., formed on a knitting machine as discussed above). The textile component 602 may have any suitable feature described in this specification. As shown, the textile component 602 may include a first knitted portion 604 and a second knitted portion 606, where the first knitted portion 604 and the second knitted portion 606 are separated such that a gap 608 exists therebetween (e.g., similar to the gap 574 discussed above with respect to FIG. 5). While the textile component 602 may be used for any suitable application, it is contemplated that the textile component 602 may form at least a portion of an upper for an article of footwear. For example, the first knitted portion 604 and the second knitted portion 606 may form medial and lateral sides of an upper, and a third knitted portion 610 may form at least one of a toe area and a heel area of the upper. The gap 608 may be located in a throat area of the upper (and a tongue may be later attached or knitted with the depicted portions, for example).

The gap 608 may lack knitted loops when the textile component 602 is a knitted component, for example, such that an opening is formed between the first knitted portion 604 and the second knitted portion 606. Optionally, a third knitted portion 610 may connect the first knitted portion 604 and the second knitted portion 606 via a plurality of knitted courses (e.g., when the first knitted portion 604, the second knitted portion 606, and the third knitted portion 610 are formed together on a knitting machine). For example, the first knitted portion 604 may be connected to the third knitted portion 610 via at least one common knit structure (e.g., a set of intermeshed knit loops). Similarly, the second knitted portion 606 may be connected to the third knitted portion 610 via at least one common knit structure (e.g., a set of intermeshed knit loops).

The textile component 602 may include at least one inlaid strand. For example, FIG. 6 depicts an embodiment having a first inlaid strand 612 and a second inlaid strand 614, but in other embodiments, one or more of the inlaid strands 612 and 614 may be excluded. The first inlaid strand 612 may be at least partially inlaid within the first knitted portion 604. Certain methods of inlaying an inlaid strand into at least one course of a knitted component and resulting structures are described in U.S. Pat. No. 8,839,532 (from U.S. patent application Ser. No. 13/048,514), titled "ARTICLE OF FOOTWEAR INCORPORATING A KNITTED COMPONENT," which is hereby incorporated by reference in its entirety.

Optionally, the first inlaid strand 612 may be inlaid only through a portion of the cross section of the first knitted portion 604. As shown in FIG. 6A, the first inlaid strand 612 may be inlaid through a first area 616 of the first knitted portion 604. For example, the first area 616 may be formed with a double jersey having knitted loops on both sides of the first inlaid strand 612 (e.g., sides facing the front and back of the textile component from the perspective of FIG. 6A) such that the first inlaid strand 612 is between front and back surfaces of the first area 616 of the first knitted portion 604. At a different location (e.g., adjacent to the second area 618 of the first knitted portion 604), the first inlaid strand 612 may not be inlaid but instead exposed outside the knitted loops. Moving from being inlaid (as in the first area 616) to not being inlaid (as in the second area 618) may be accomplished by transferring loops from one needle bed to another during the inlay process (e.g., such that no loops are located on one side of the first inlaid strand 612 along its non-inlaid length, for example). Thus, the first inlaid strand 612 may extend from a first point 620 to a second point 622 while being inlaid. By contrast, the first inlaid strand 612 may be exposed, freely movable, and accessible relative to the remainder of the textile component 602 elsewhere. Advantageously, the locations where the first inlaid strand is inlaid may be selected during product design for accomplishing particular functions (e.g., providing the textile component 602 with an engineered force distribution, for example).

Optionally, the first inlaid strand 612 may be coupled to a fourth knitted portion 626 (which may function, for example, as a strap fastener, such as the strap fastener 158 of FIGS. 1-2, for example). In certain embodiments (including the embodiment depicted in FIG. 6A), the first inlaid strand 612 is also inlaid through knitted courses of the fourth knitted portion 626 (e.g., where the fourth knitted portion 626 is formed on different needles of the knitting machine forming the first knitted portion 604). Advantageously, the fourth knitted portion 626 may be secured to the first inlaid strand 612 after the knitting process (increasing the durability of the textile component 602 along with manufacturing efficiency). It is contemplated that this inlaid orientation may allow the fourth knitted portion 626 to be slidable along the first inlaid strand 612 (e.g., such that the fourth knitted portion 626 can be adjusted for sizing). Additionally or alternatively, at least one of the ends 630 of the first inlaid strand 612 may be movable to adjust the slack of the first inlaid strand 612. In particular, the slack 632 between the first knitted portion 604 and the fourth knitted portion 626 (which may be in a second gap 634) may be controlled. Advantageously, such control may allow adjustability of a length of a strap formed by the first inlaid strand 612 and the fourth knitted portion 626, for example. To illustrate, FIG. 6B shows the embodiment of FIG. 6A where the slack 632 has been shortened via displacement (e.g., pulling) of the ends 630. While not shown in FIGS. 6A-6B, an actuator (e.g., a clamp or other operable fastener) may be included to fix the ends 632 of the first inlaid strand 612 relative to the fourth knitted portion 626 when an appropriate amount of slack within the first inlaid strand 612 is achieved. Additionally or alternatively, at least one of the ends 630 of the first inlaid strand may be secured to the fourth knitted portion 626 via sewing, an adhesive, a staple, a pin or another added fastener.

The second inlaid strand 614 may have any of the features discussed above with respect to the first inlaid strand 612 (e.g., it may mirror the characteristics of the first inlaid strand 612). However, the second inlaid strand 614 has certain features that are different from the features of the first inlaid strand 612. For example, the second inlaid strand 614 is inlaid through substantially the entirety of certain courses forming the second knitted portion 606. That is, inlaid portions of the second inlaid strand 614 extend substantially across the cross-sectional length of the second knitted portion 606 in the course-wise direction. Further, in the embodiment depicted in FIGS. 6A-6B, the second inlaid strand 614 is not associated with a strap fastener (although a strap fastener could be included with the second inlaid strand 614 in other embodiments). Instead, the second inlaid strand 614 immediately exits and re-enters the courses of the second knitted portion 606 at the edge 636. In this embodiment, adjustment of the second inlaid strand 614 may be performed by manipulating a loose end 638 of the second inlaid strand 614, for example.

As shown in FIGS. 6A-6B, the first inlaid strand 612 may engage the second inlaid strand 614 within the gap 608. In this particular embodiment, a set of first loops 640 are formed by the first inlaid strand 612 where the first inlaid strand 612 changes directions in the gap 608. Similarly, a set of second loops 642 are also formed by the second inlaid strand 614 where the second inlaid strand 614 changes directions in the gap 608. The two sets of loops engage such that they are interlooped, and in particular such that the first inlaid strand 612 extends through the second loops 642 and such that the second inlaid strand 614 extends through the first loops 640. As a result (and some or all slack is removed), pulling on the first inlaid strand 612 (and/or the first knitted portion 604) will transfer a force to the second inlaid strand 614 (and/or the second knitted portion 606), and vice versa.

Advantageously, such an embodiment may create a system for securing the textile component 602 and/or tightening the textile component 602 when used in an article of footwear, article of apparel, or other article. For example, if the gap 608 is located in a throat area of an upper for an article of footwear (such as an article of footwear 100), the first inlaid strand 612 and the second inlaid strand 614 may be combined to form a fastening system of the article of footwear (perhaps taking the place of a typical shoelace, for example). In such an embodiment, pulling the strap fastener (in this case, the fourth knitted portion 626) may be the only action required to tighten the textile component 602 around a wearer's foot, for example.

Figure 7:
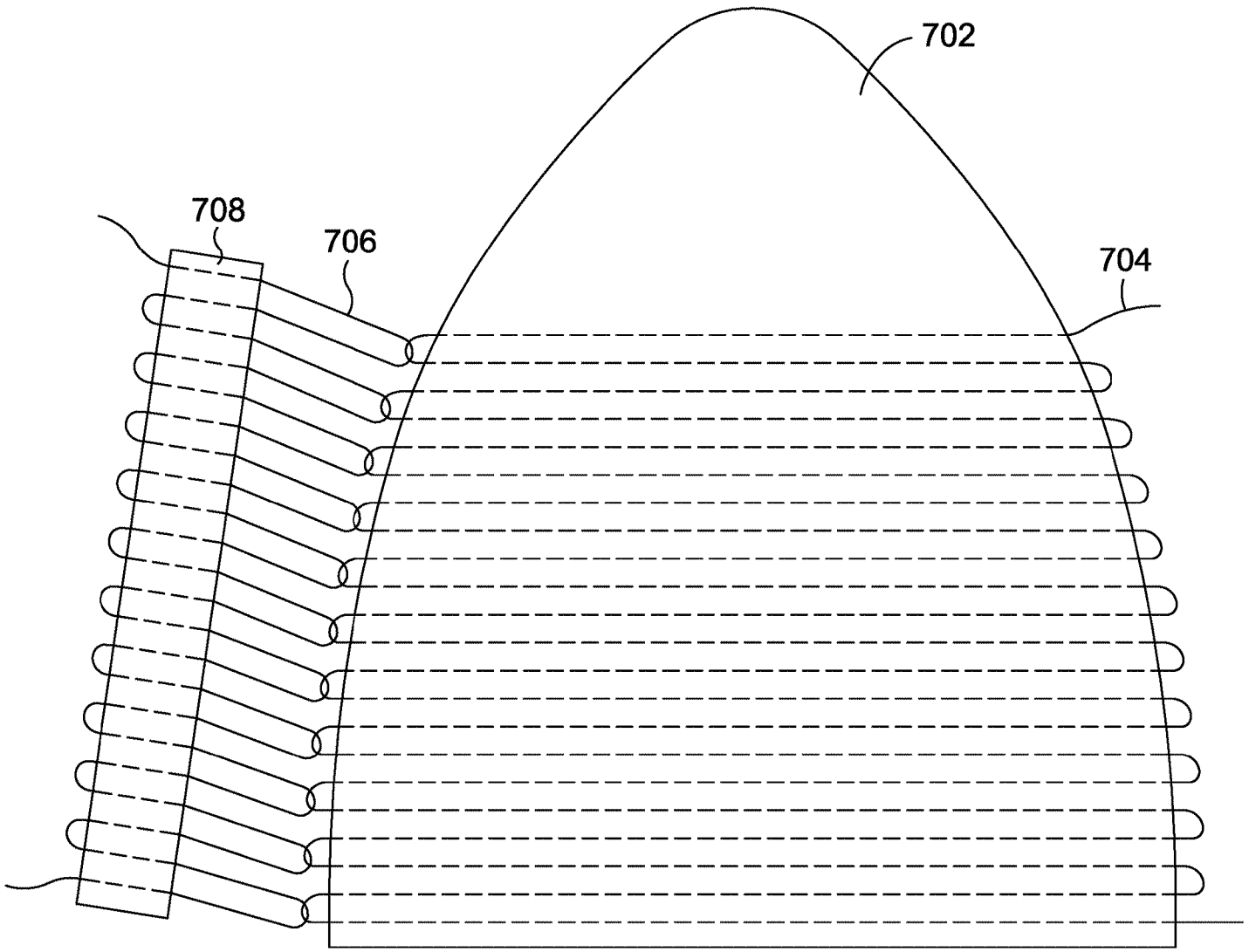
FIG. 7 is an illustration showing an embodiment similar to the embodiment depicted in FIGS. 1-2.

FIG. 7 depicts of an example knitted component 702 for use in an article of footwear, such as the article of footwear 100 of FIGS. 1-2. The knitted component 702 of FIG. 7 is similar to the textile component 602 of FIGS. 6A and 6B. Additionally, the knitted component 702 includes several of the aspects discussed above, and particularly aspects incorporated into FIGS. 1-3, for example. As shown, the knitted component 702 includes a first inlaid strand 704 that extends through the knitted component 702 and forms an underfoot portion such that the first inlaid strand 704 would at least partially extend under the foot of a wearer once incorporated into an article of footwear. The knitted component 704 also includes a second inlaid strand 706 that is inlaid through a strap fastener 708, which is similar to the strap fastener 162 depicted above in FIGS. 1-2. Like certain strap fasteners described herein (e.g., such as that formed by the fourth knitted portion 626 of FIG. 6), the strap fastener 708 is knitted, having the second inlaid strand 706 extending through the knitted structure of the strap fastener 708. As discussed above with reference to FIGS. 1-3, the first inlaid strand 704 is engaged with the second inlaid strand 706 via interlooping such that pulling the second inlaid strand 706 transfers force to the first inlaid strand 704 (and therefore through the underfoot portion of the knitted component 702).

Figure 8:
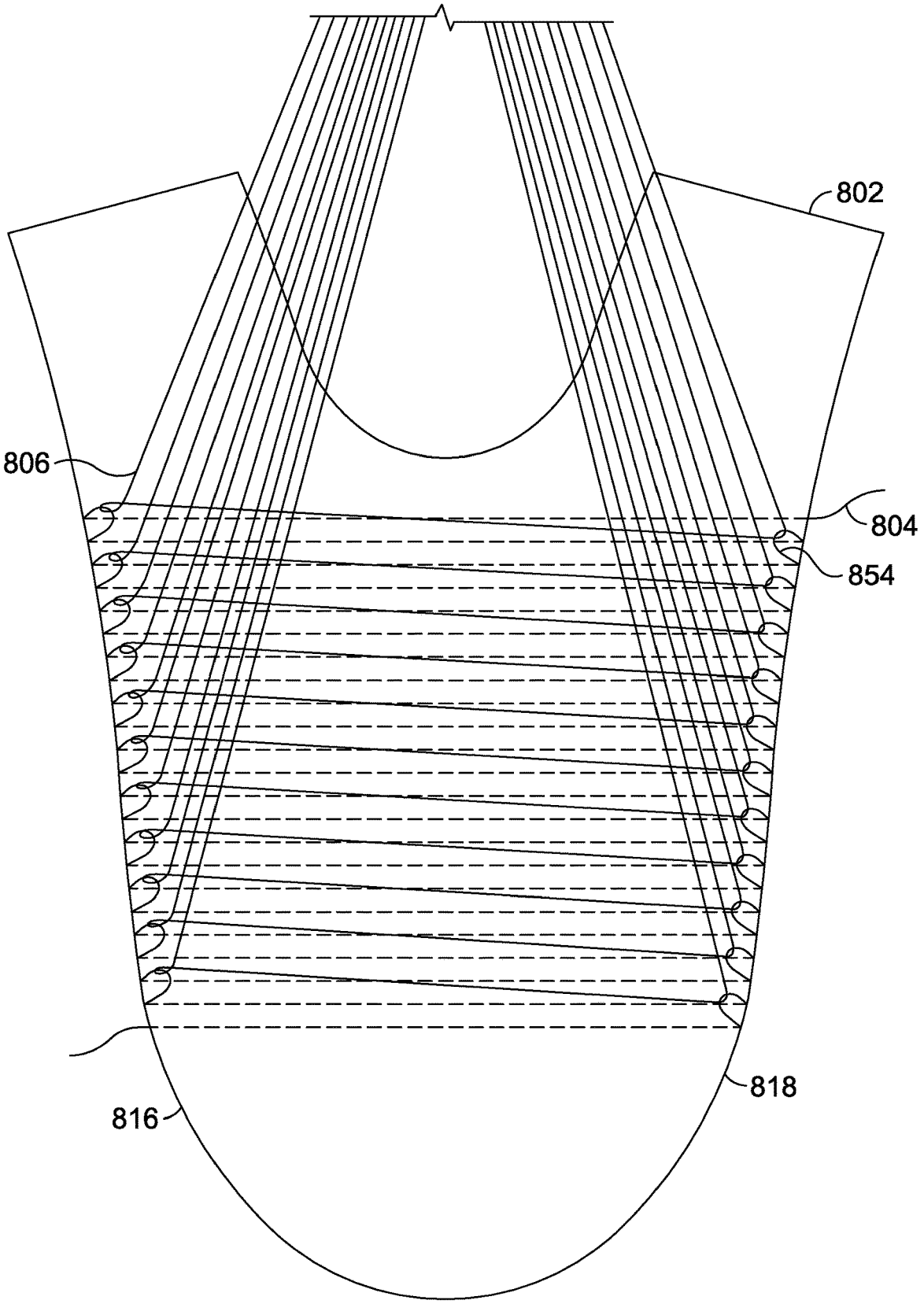
FIG. 8 is an illustration showing an embodiment similar to the embodiment depicted in FIGS. 1-2 with certain variations as described below.

FIG. 8 shows an embodiment of a knitted component 802 for an article of footwear similar to the knitted component 702 of FIG. 7, except where the inlaid strands engage with each other in a different manner. The knitted component 802 includes a first inlaid strand 804 and a second inlaid strand 806. The second inlaid strand 806 is engaged with loops (e.g., exposed loop 854) of the first inlaid strand 804 on both sides (e.g., a medial side 816 and a lateral side 818) of the knitted component 804. This embodiment may be suitable for use with certain types of fastening systems incorporated into an article of footwear, for example.

Figure 9:
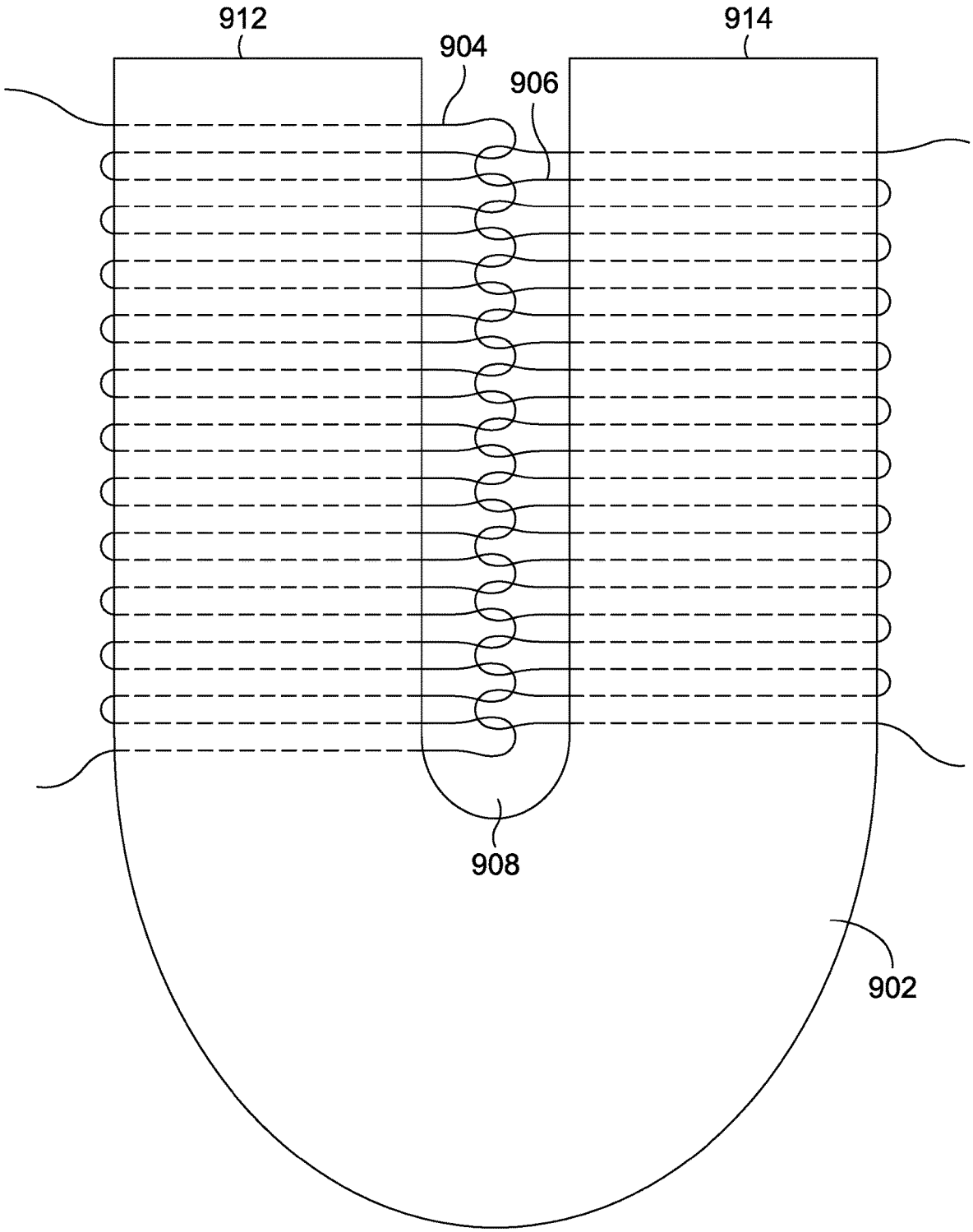
FIG. 9 is an illustration showing an embodiment similar to the embodiment depicted in FIG. 6A with certain variations as described below.

FIG. 9 shows an embodiment of an upper formed by a knitted component 902 that is similar to the textile component 602 depicted in FIGS. 6A-6B (with certain differences). For example, the knitted component 902 includes a first inlaid strand 904 and a second inlaid strand 906 that are similar to the first and second inlaid strands 612 and 614, respectively, of FIG. 6A. Each of the first inlaid strand 904 and the second inlaid strand 906 are inlaid through courses of the knitted component 902 such that when incorporated into an upper, the first inlaid strand 904 will be on a lateral side and the second inlaid strand 906 will be on a medial side (or vice versa). As shown, the first and second inlaid strands 904 and 906 engage one another in a gap 908 defined at least by two knitted portions (such as a first knitted portion 912 that may be on a lateral side and a second knitted portion 914 that may be on a medial side). The gap 908 may be located in the upper's throat area such that engagement of the first and second inlaid strands 904 and 906 may be in a throat area. Pulling on at least one of the first inlaid strand 904 and the second inlaid strand 906 may tighten the upper around the foot (as described in more detail above).

Figure 10:
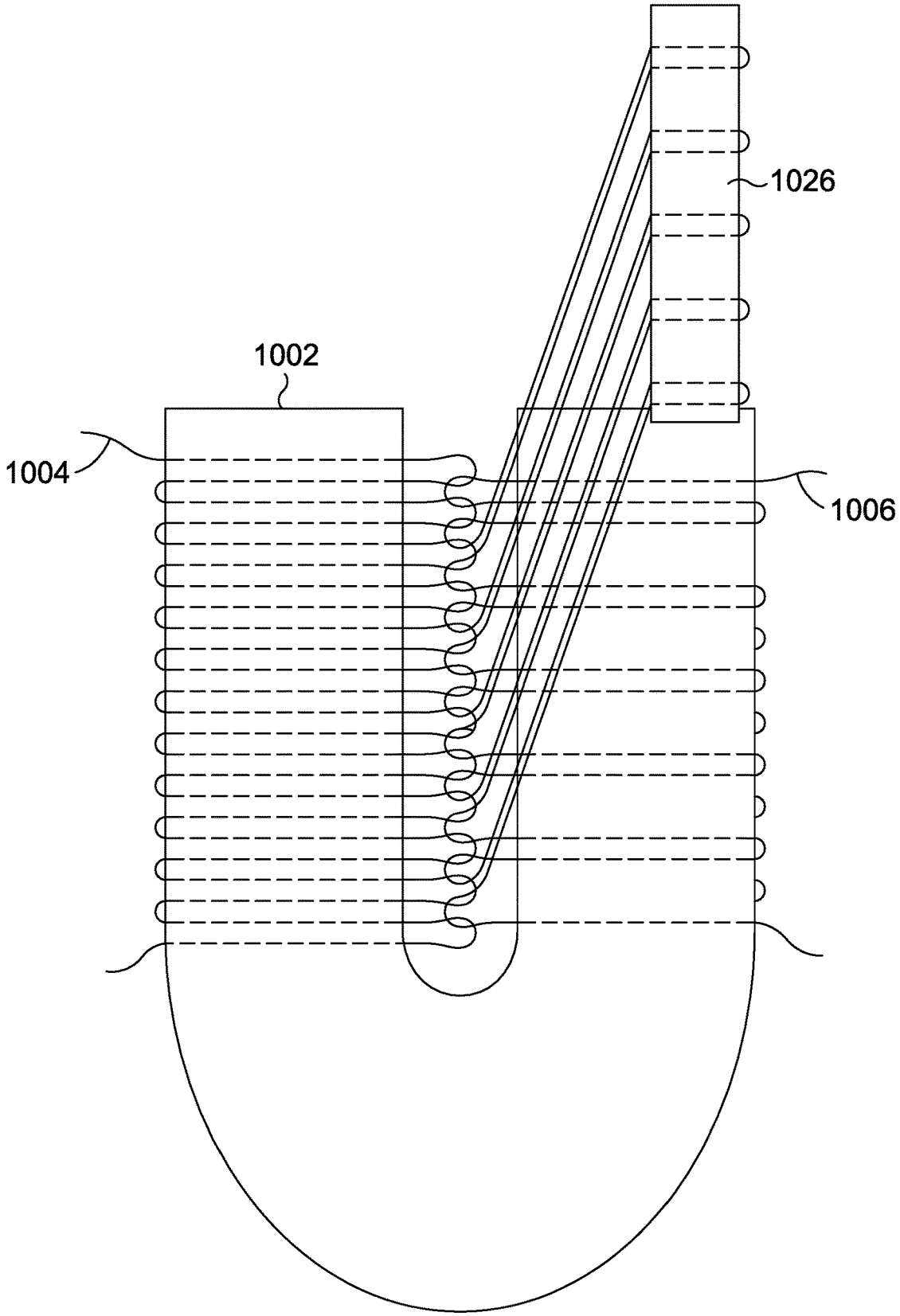
FIG. 10 is an illustration showing another embodiment similar to the embodiment depicted in FIG. 6A with certain variations as described below.

As with all embodiments described herein, certain variations are possible (such as adapting the first inlaid strand 904 (or both depicted inlaid strands of FIG. 9) such that it functions like the first inlaid strand 612 shown in FIGS. 6A-6B, for example). FIG. 10 depicts such an example. In FIG. 10, a knitted component 1002 with a first inlaid strand 1004 and a second inlaid strand 1006 is similar to the knitted component 902 of FIG. 9 except that the second inlaid strand 1006 may include exposed portions that, after extending through exposed loops of the first inlaid strand 1004, may be secured to a strap fastener 1026, similar to the fourth knitted portion 626 of FIG. 6A.

Figure 11:
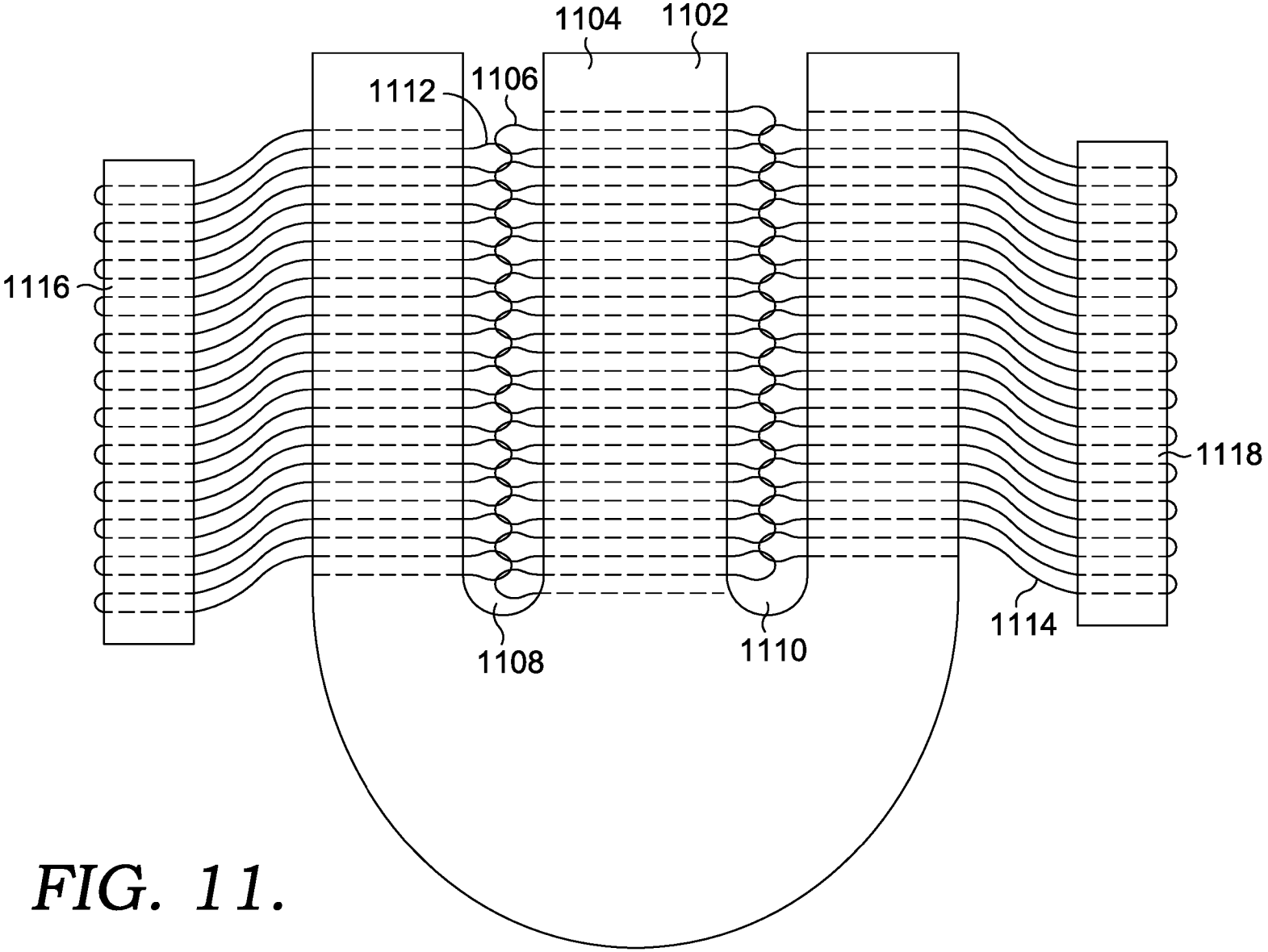
FIG. 11 is an illustration showing another embodiment similar to the embodiment depicted in FIG. 6A with certain variations as described below, in accordance with certain aspects of the present disclosure.

FIG. 11 depicts another example of an embodiment in accordance with certain aspects of this disclosure. In particular, FIG. 11 depicts a knitted component 1102 for use in an upper for an article of footwear, such as the article of footwear 100. The knitted component 1102 is similar to the knitted component 902 of FIG. 9 (and thus the textile component 602 of FIG. 6), but it includes an additional central knitted portion 1104 that has a dedicated (separate) central inlaid strand 1106. Optionally, the central knitted portion 1104 may at least partially form a tongue of the upper. In this embodiment, a first gap 1108 and a second gap 1110 are formed on medial and lateral sides of the upper's throat area. A first inlaid strand 1112 and a second inlaid strand 1114 each engage the central inlaid strand 1106 in the first gap 1108 and the second gap 1110, respectively. For example, an exposed loop formed by the first inlaid strand 1112 may be looped through one or more exposed loops of the central inlaid strand 1106 in the first gap 1108, and an exposed loop formed by the second inlaid strand 1114 may be looped through one or more exposed loops of the central inlaid strand 1106 in the second gap 1110.

Optionally, and as depicted, the first inlaid strand 1112 may be secured to (e.g., inlaid through) a first strap fastener 1116 and the second inlaid strand 1114 may be secured to (e.g., inlaid through) a second strap fastener 1118. Adjusting one or both of the strap fasteners may tighten the upper around a foot with sufficient flexibility to ensure a comfortable (and otherwise suitable) fit. Additionally or alternatively, the central inlaid strand 1106 may be adjustable (e.g., by pulling on a loop or a free end of the central inlaid strand 1106) to add to the customization of the fit.

Figure 12:
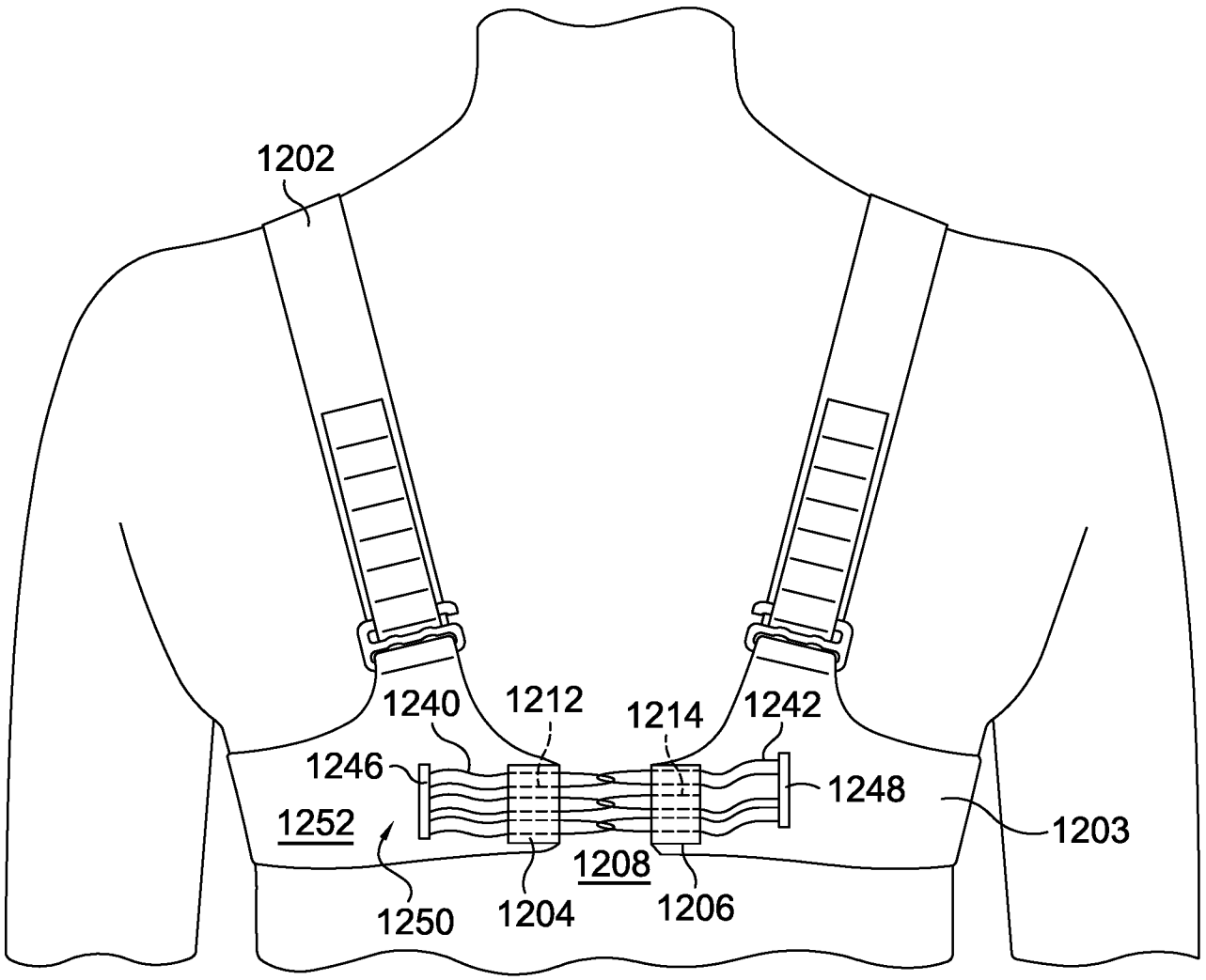
FIG. 12 is an illustration showing a fastening system for an article of apparel having incorporated two separate inlaid strands that interloop in accordance with certain aspects herein.
Figure 13:
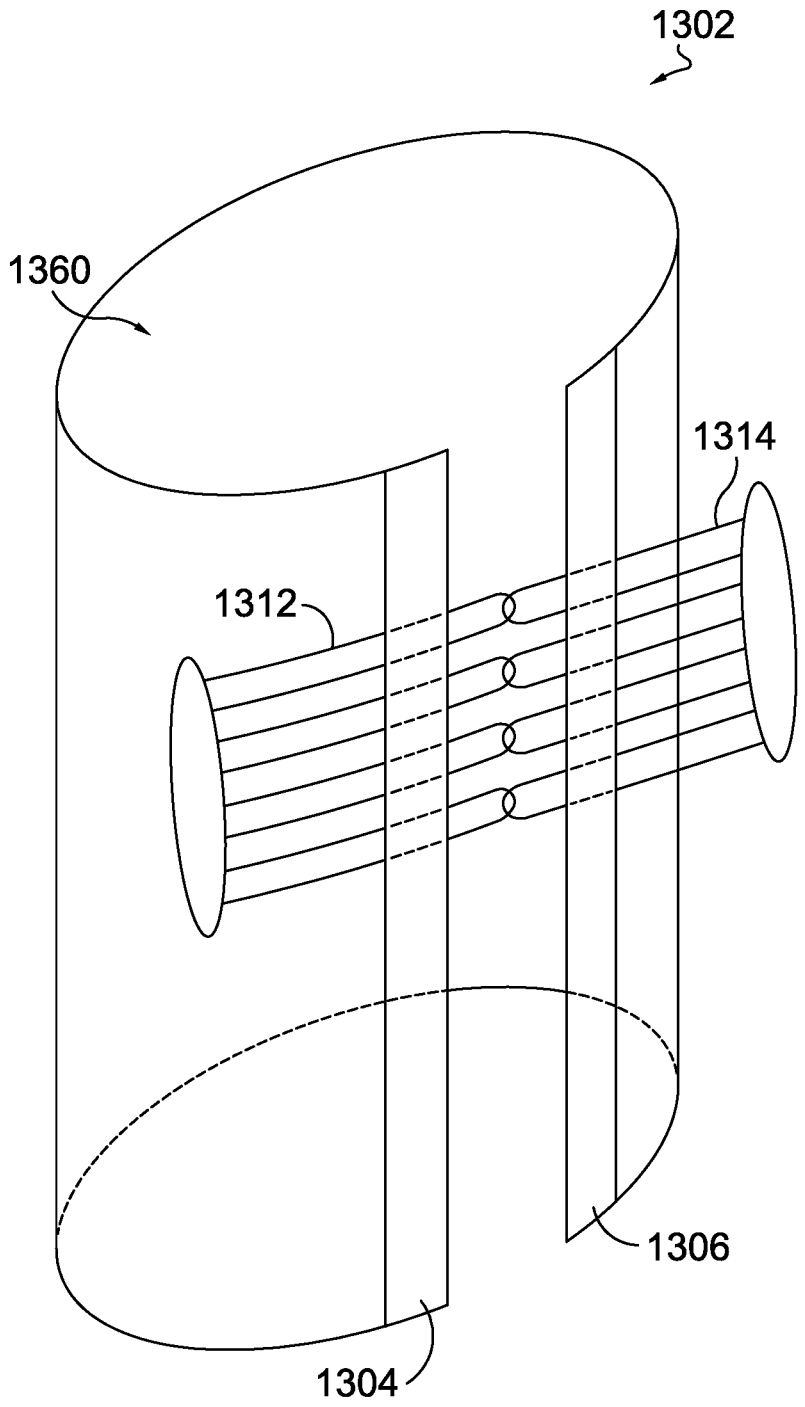
FIG. 13 is an illustration showing a knitted component or other textile component forming an adjustable sleeve in accordance with certain aspects herein.

As mentioned above, certain aspects of this disclosure may be used in articles other than those incorporated into articles of footwear. FIG. 12 shows an example of related aspects being used in a bra 1202, for example. As shown, the bra 1202 may be at least partially formed by a knitted component 1203. In this case, all of the fabric portions of the bra 1202 are knitted, for example.

The bra 1202 may be adjustable via adjustment of at least one of a first inlaid strand 1212 and a second inlaid strand 1214, for example. As shown, the first inlaid strand 1212 is inlaid through a first knitted portion 1204, and the second inlaid strand 1214 is inlaid through a second knitted portion 1206. The first inlaid strand 1212 includes a first slack area 1240 extending between the first knitted portion 1204 and a first strap fastener 1246, and the second inlaid strand 1214 includes a second slack area 1242 extending between the second knitted portion 1206 and a second strap fastener 1248. Optionally, the first strap fastener 1246 and/or the second strap fastener 1248 may be knitted (e.g., where the respective inlaid strands are inlaid therethrough), but this is not required. The first strap fastener 1246 and/or the second strap fastener 1248 may be securable to an outer surface 1250 of a base area 1252 of the bra 1202, for example. Thus, during user adjustment, the first strap fastener 1246 and/or the second strap fastener 1248 may be pulled until a sufficient tightness/fit is accomplished and then at least one of the strap fasteners 1246 and 1248 may be secured into place.

Like the embodiment of FIGS. 6A-6B, the embodiment of FIG. 12 includes a gap 1208 where inlaid strands are interlooped. In particular, the first inlaid strand 1212 includes loops in the gap 1208 that engage corresponding loops of the second inlaid strand 1214. Thus, pulling on the first strap fastener 1246 will transfer force to the second inlaid strand 1214 (and vice versa). While such an embodiment is advantageous for enhancing the degree of adjustability, it is also contemplated that only one of the first inlaid strand 1212 and the second inlaid strand 1214 may be adjustable by a user during normal use since adjusting only one of the first strap fastener 1246 and the second strap fastener 1248 may be sufficient.

Similar systems may be incorporated into other types of articles (e.g., other articles of apparel). As shown in FIG. 10, a similar sleeve-shaped article 1302 includes a first inlaid strand 1312 and a second inlaid strand 1314 that are respectively inlaid through a first knitted portion 1304 and a second knitted portion 1306. Pulling on at least one of the first inlaid strand 1312 and the second inlaid strand 1314 may cause the article 1302 to change its geometry (e.g., reduce its diameter), thereby tightening the article 1302 around an object within a cavity 1360 formed by the article 1302, for example. The article 1302 may be, or may be incorporated within, any suitable device. By way of non-limiting example, the article 1302 may be an adjustable sleeve of a shirt or other article of apparel, a medical or sports device for creating compression around an appendage (arm, leg, finger, etc.), a sock, or an article outside the context of apparel.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1: An article of footwear, comprising: a knitted component, the knitted component comprising a plurality of courses; and at least one inlaid strand, wherein the at least one inlaid strand is inlaid within at least one course of the plurality of courses, and wherein the at least one inlaid strand includes an exposed loop on a first side of the knitted component and an exposed portion, the exposed portion extending from a second side of the knitted component, at least partially over the throat area and through the exposed loop on the first side.

Clause 2: The article of footwear of clause 1, further comprising a strap fastener that is fixed to an end of the at least one inlaid strand.

Clause 3: The article of footwear of any of clauses 1-2, wherein the strap fastener is configured to releasably attach to a surface fastener located on an exterior surface of the article of footwear.

Clause 4: The article of footwear of any of clauses 1-3, wherein the exposed loop is located on a medial side or a lateral side of the throat area of the article of footwear.

Clause 5: The article of footwear of any of clauses 1-4, wherein after extending through the exposed loop, the exposed portion of the at least one inlaid strand extends back from the first side of the knitted component, at least partially over the throat area, and to the second side of the knitted component.

Clause 6: The article of footwear of clause of any of clauses 1-5, wherein an end of the exposed portion of the at least one inlaid strand is fixed to a strap fastener, and wherein the strap fastener is configured to releasably attach to a surface fastener located on the second side of the knitted component.

Clause 7: The article of footwear of any of clauses 1-6, wherein the at least one inlaid strand at least partially extends through an underfoot portion of the article of footwear.

Clause 8: The article of footwear of any of clauses 1-7, wherein the at least one inlaid strand at least partially extends through a heel area of the article of footwear.

Clause 9: The article of footwear of any of clauses 1-8, wherein the at least one inlaid strand comprises a material having greater stretch resistance than material forming the plurality of courses of the knitted component.

Clause 10: An article of footwear, comprising: a knitted component, the knitted component comprising a plurality of courses; at least one inlaid strand, wherein the at least one inlaid strand is inlaid within at least one course of the plurality of courses, the at least one inlaid strand including an exposed loop located on at least one of a medial side or a lateral side of a throat area of the article of footwear; a fastening system that at least partially extends through the exposed loop of the at least one inlaid strand; and a strap fastener fixed to an end of the fastening system and being configured to releasably attach to a surface fastener located on an exterior surface of the article of footwear.

Clause 11: The article of footwear of clause 10, wherein the fastening system at least partially extends through the throat area of the article of footwear.

Clause 12: The article of footwear of any of clauses 10-11, wherein the surface fastener is located a medial side or a lateral side of the article of footwear.

Clause 13: The article of footwear of, any of clauses 10-12 wherein the at least one inlaid strand comprises a material having greater stretch resistance than material forming the plurality of courses of the knitted component.

Clause 14: The article of footwear of any of clauses 10-13, wherein the at least one inlaid strand includes a first exposed loop located on a first side of the knitted component and a second exposed loop located on a second side of the knitted component, wherein the fastening system is interlooped with the first exposed loop and extends through the second exposed loop.

Clause 15: The article of footwear of any of clauses 10-14, wherein an end of the fastening system extending through the second exposed loop is fixed to a strap fastener, and wherein the strap fastener is configured to releasably attach to a surface fastener located on the second side of the knitted component.

Clause 16: The article of footwear of any of clauses 10-14, wherein an end of the fastening system extending through the second exposed loop is fixed to a strap fastener, and wherein the strap fastener is configured to releasably attach to a surface fastener located on the first side of the knitted component.

Clause 17: A textile component, comprising: a first textile portion, the first textile portion comprising a first plurality of knit courses; a second textile portion; and at least one strand extending from the first textile portion to the second textile portion, wherein the at least one strand is inlaid within at least one course of the first plurality of knit courses, and wherein the at least one strand extends through an entirety of a gap extending between the first textile portion and the second textile portion, the gap excluding knit courses.

Clause 18: The textile component of clause 17, wherein the second textile portion comprises a second plurality of knit courses, and wherein the at least one strand is inlaid within at least one course of the second plurality of knit courses.

Clause 19: The textile component of any of clauses 17-18, wherein the at least one strand forms an exposed loop located on a first side of the first textile portion or a second side of the second textile portion, and wherein the at least one strand includes at least one exposed portion located in the gap.

Clause 20: The textile component of any of clauses 17-18, wherein the at least one strand forms a first exposed loop located on a first side of the first textile portion and a second exposed loop located on a second side of the second textile portion.

Clause 21: A textile component, comprising: a first knitted portion; a first strand at least partially inlaid through the first knitted portion; a second knitted portion, wherein the second knitted portion is spaced from the first knitted portion such that a gap is located between the first knitted portion and the second knitted portion; and a second strand that is at least partially inlaid through the second knitted portion, wherein the first strand forms a first loop between the first knitted portion and the second knitted portion, wherein the second strand forms a second loop between the first knitted portion and the second knitted portion, wherein the first strand extends through the second loop, and wherein the second strand extends through the first loop.

Clause 22: The textile component of clause 21, wherein the first strand is at least partially inlaid through a third knitted portion, wherein a slack of the first strand is located between the first knitted portion and the third knitted portion.

Clause 23: The textile component of any of clauses 21-22, wherein a free end of the first strand is movable relative to the third knitted portion to adjust the slack between the first knitted portion and the third knitted portion.

Clause 24: The textile component of any of clauses 21-23, wherein the third knitted portion is securable relative to at least one of the first knitted portion and the second knitted portion such that it forms a strap fastener.

Clause 25: The textile component of any of clauses 21-24, wherein the textile component is incorporated into an upper for an article of footwear.

Clause 26: The textile component of any of clauses 25, wherein the gap is located in a throat area of the upper or adjacent to the throat area.

Clause 27: The textile component of any of clauses 21-26, further comprising a third strand that engages the second strand in a second gap, wherein the second strand is located in a throat area of the upper.

Clause 28: The textile component of any of clauses 21-27, wherein the textile component at least partially forms an article of apparel.

Clause 29: The textile component of clause 28, wherein the article of apparel is a bra.

Clause 30: The textile component of clause 28, wherein the article of apparel is a sleeve.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. An article of footwear, comprising: a knitted component comprising a plurality of courses, wherein the knitted component comprises an underfoot portion configured to extend beneath a foot, a medial portion extending upward from the underfoot portion and terminating at a first edge on a medial side, and a lateral portion extending upward from the underfoot portion and terminating at a second edge on a lateral side opposite to the first edge; at least one first inlaid strand, wherein the at least one first inlaid strand is inlaid within at least one course of the plurality of courses and forms a plurality of exposed loops along the first edge and along the second edge; and a fastening system comprising a second strand, wherein the second strand extends through one of the plurality of exposed loops on the second edge, traverses across a throat area from the second edge to the first edge, extends through and at least partially around one of the plurality of exposed loops on the first edge, returns across the throat area from the first edge to the second edge, and through the one of the plurality of exposed loops on the second edge.

2. The article of footwear of claim 1, wherein the second strand is tensionable to adjust a fit of the article of footwear by causing the medial and lateral portions of the knitted component to shift towards each other conform to a wearer's foot.

3. The article of footwear of claim 2, further comprising a strap fastener that is fixed to an end of the second strand.

4. The article of footwear of claim 3, wherein the strap fastener is configured to releasably attach to a surface fastener located on an exterior surface of the article of footwear.

5. The article of footwear of claim 3, wherein the strap fastener comprises a first surface configured to releasably engage a surface fastener disposed on the knitted component, and wherein the strap fastener and the surface fastener together enable adjustable tensioning of the second strand.

6. The article of footwear of claim 1, wherein the second strand continuously extends through the one of the plurality of exposed loops on the first edge and the one of the plurality of exposed loops on the second edge, such that tension applied to the second strand is capable of tightening a fit of the article of footwear.

7. The article of footwear of claim 1, wherein the at least one first inlaid strand extends through the underfoot portion of the knitted component.

8. The article of footwear of claim 1, wherein the at least one first inlaid strand is located in a heel area of the knitted component and resists stretch in the heel area.

9. The article of footwear of claim 1, wherein the at least one first inlaid strand comprises a first material having a greater stretch resistance than a second material forming the plurality of courses of the knitted component.

* * * * *